US008107833B2

(12) United States Patent
Yoshida

(10) Patent No.: US 8,107,833 B2
(45) Date of Patent: Jan. 31, 2012

(54) IMAGE FORMING APPARATUS AND METHOD OF CORRECTING COLOR MISREGISTRATION IN IMAGE FORMING APPARATUS

(75) Inventor: Yoshiki Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1077 days.

(21) Appl. No.: 11/556,321

(22) Filed: Nov. 3, 2006

(65) Prior Publication Data

US 2007/0110461 A1 May 17, 2007

(30) Foreign Application Priority Data

Nov. 11, 2005 (JP) ..... 2005-327673

(51) Int. Cl.
*G03G 15/00* (2006.01)

(52) U.S. Cl. ..... 399/44; 399/51; 399/72; 399/94; 399/301; 347/116

(58) Field of Classification Search ..... 399/15, 399/44, 51, 72, 301, 94; 347/116
See application file for complete search history.

(56) References Cited

U.S. PATENT DOCUMENTS 4,937,664 A * 6/1990 Chiku et al. ..... 358/526
4,967,284 A 10/1990 Yoshida et al.
5,309,182 A 5/1994 Mama et al.
5,376,994 A 12/1994 Mama et al.
5,828,925 A * 10/1998 Yoshizawa ..... 399/39
5,966,557 A * 10/1999 Wada ..... 399/43
5,995,802 A * 11/1999 Mori et al. ..... 399/394
6,327,453 B1 * 12/2001 Imaizumi et al. ..... 399/301
6,418,295 B1 * 7/2002 Sato ..... 399/301
6,480,693 B2 * 11/2002 Liston et al. ..... 399/301
6,788,320 B2 * 9/2004 Yoshida ..... 347/116
7,343,110 B2 * 3/2008 Sakamoto ..... 399/44
7,376,375 B2 * 5/2008 Kobayashi et al. ..... 399/301
7,729,024 B2 * 6/2010 Kobayashi et al. ..... 358/526
2002/0089579 A1 * 7/2002 Yamanaka et al. ..... 347/116
2004/0036757 A1 2/2004 Yoshida
2004/0057756 A1 * 3/2004 Taka et al. ..... 399/301
2004/0218959 A1 * 11/2004 Shiraishi ..... 400/118.2
2004/0246329 A1 12/2004 Yoshida
2005/0041990 A1 * 2/2005 Sugiyama ..... 399/49
2005/0238372 A1 * 10/2005 Shinohara et al. ..... 399/44

(Continued)

FOREIGN PATENT DOCUMENTS

JP 3036400 2/2000

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A determining unit determines whether a difference between a temperature value and a temperature detected by a temperature detecting unit is equal to or larger than a first value. A pattern forming unit, when the determining unit determines that the difference is equal to or larger than the first value, forms a pattern for measurement including sub-patterns of a plurality of colors on a transfer medium. A calculating unit calculates a misregistration-amount for each sub-pattern based on a detected position of the sub-pattern and a predetermined position of the sub-pattern. A correcting unit corrects a position on which the sub-pattern is to be formed based on the misregistration-amount. An image forming unit forms an image for each color factoring in corrected position for each color.

16 Claims, 16 Drawing Sheets

U.S. PATENT DOCUMENTS

| | | | | |
|---|---|---|---|---|
| 2006/0013603 | A1* | 1/2006 | Matsuyama | 399/49 |
| 2006/0139433 | A1 | 6/2006 | Yoshida | |
| 2006/0177246 | A1* | 8/2006 | Kawada et al. | 399/301 |
| 2007/0097465 | A1* | 5/2007 | Kobayashi et al. | 358/518 |
| 2007/0206256 | A1* | 9/2007 | Itabashi | 359/196 |
| 2007/0274745 | A1* | 11/2007 | Ueda et al. | 399/301 |
| 2008/0279599 | A1* | 11/2008 | Nagatsuka | 399/301 |

FOREIGN PATENT DOCUMENTS

| | | |
|---|---|---|
| JP | 2000-71516 | 3/2000 |
| JP | 2002-372676 | 12/2002 |
| JP | 2005-189356 | 7/2005 |
| JP | 2006-189625 | 7/2006 |
| JP | 2006-194996 | 7/2006 |
| JP | 2006-195082 | 7/2006 |

* cited by examiner

IMAGE FORMING APPARATUS AND METHOD OF CORRECTING COLOR MISREGISTRATION IN IMAGE FORMING APPARATUS

CROSS-REFERENCE TO RELATED APPLICATIONS

The present document incorporates by reference the entire contents of Japanese priority document, 2005-327673 filed in Japan on Nov. 11, 2005.

BACKGROUND OF THE INVENTION

1. Field of the Invention

The present invention generally relates to an image forming apparatus, and specifically relates to a method of correcting color misregistration in an image forming apparatus.

2. Description of the Related Art

An image forming apparatus that forms a color image with a plurality of colors generally has been configured that the image for each color is separately developed for transfer onto a transfer member or a recording sheet. Therefore, there has been a problem in which a color misregistration occurs in each plate at the time of a transfer for each color.

To solve this problem, a technology is disclosed in Japanese Patent Laid-Open Publication No. 2000-71516, in which technology includes, for measuring a color misregistration amount of an optical-beam scanning apparatus, inputting the measurement value from an operating unit, calculating a correction value based on the input value, and then storing the calculated corrected value in a storage unit. In this technology, the correction value is stored in the image forming apparatus when a correction was performed at the time of a previous power-on, and color misregistration correction is performed at the time of power-on by using the stored correction value, thereby aiming at a more accurate color misregistration correction.

Although the color misregistration correction is always performed at the time of power-on by using the stored correction value in the technology disclosed, in practical use of the image forming apparatus, a color misregistration does not so often occur when, for example, the state of the previous use of the apparatus is similar to that of at the time of power-on this time. In the technique disclosed, the color misregistration correcting operation is often performed even when not needed.

SUMMARY OF THE INVENTION

It is an object of the present invention to at least partially solve the problems in the conventional technology.

According to an aspect of the present invention, an image forming apparatus includes a temperature storage unit that stores therein a temperature value; a temperature detecting unit that detects a temperature within the image forming apparatus; a determining unit that determines whether a difference between the temperature value and the temperature detected by the temperature detecting unit is equal to or larger -than a first value; a pattern forming unit that, when the determining unit determines that the difference is equal to or larger than the first value, forms a pattern for measurement including sub-patterns of a plurality of colors on a transfer medium; a position detecting unit that detects positions of the sub-patterns of each of the colors on the transfer medium; a calculating unit that calculates a misregistration-amount for each sub-pattern based on the position of the sub-pattern and a predetermined position for that sub-pattern; a correcting unit that corrects a position on which a sub-pattern is to be formed based on the misregistration-amount for that sub-pattern; and an image forming unit that forms an image for each color on the transfer medium factoring in the position of that color corrected by the correcting unit, and superposes the image onto a recording medium.

According to another aspect of the present invention, a method of correcting color misregistration in an image forming apparatus includes detecting an internal temperature of the image forming apparatus; determining whether a difference between a reference temperature value and the internal temperature is equal to or larger than a first value; forming a pattern for measurement including sub-patterns of a plurality of colors on a transfer medium when it is determined at the determining that the difference is equal to or larger than the first value; detecting positions of the sub-patterns of each of the colors on the transfer medium; calculating a misregistration-amount for each sub-pattern based on detected position of the sub-pattern and a predetermined position for that sub-pattern; correcting a position on which a sub-pattern is to be formed based on the misregistration-amount; and forming an image for each color on the transfer medium factoring in corrected position for each color so as to superpose formed image onto a recording medium.

According to still another aspect of the present invention, an image forming apparatus includes a temperature storage means for storing therein a temperature value; a temperature detecting means for detecting a temperature within the image forming apparatus; a determining means for determining whether a difference between the temperature value and the temperature detected by the temperature detecting means is equal to or larger than a first value; a pattern forming means for forming a pattern for measurement including sub-patterns of a plurality of colors on a transfer medium when the determining means determines that the difference is equal to or larger than the first value; a position detecting means for detecting positions of the sub-patterns of each of the colors on the transfer medium; a calculating means for calculating a misregistration-amount for each sub-pattern based on the position of the sub-pattern and a predetermined position for that sub-pattern; a correcting means for correcting a position on which the sub-pattern is to be formed based on the misregistration-amount for that sub-pattern; and an image forming means for forming an image for each color on the transfer medium factoring in the position of that color corrected by the correcting means, and superposes the image onto a recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

With reference to attached drawings, exemplary embodiments of an image forming apparatus, and a method of correcting color misregistration in an image forming are explained in detail.

An image forming apparatus according to a first embodiment, to prevent a color misregistration occurring at the time of image formation using a plurality of colors, a color misregistration correction is performed at the same time when the apparatus is powered on. In this embodiment, a temperature detected at the time of a color misregistration correction performed when the apparatus is powered on is stored as a reference value for calculating a temperature difference in the apparatus, and then, only when the difference between this reference value and the temperature in the apparatus is equal to or larger than a predetermined value, a color misregistration correction is performed, and when the difference does not satisfy the predetermined value, a color misregistration correction is not performed. Then, the temperature in the apparatus detected when the temperature difference in the apparatus is equal to or larger than the predetermined value is further stored in the apparatus as the next reference temperature for update.

Figure 1:
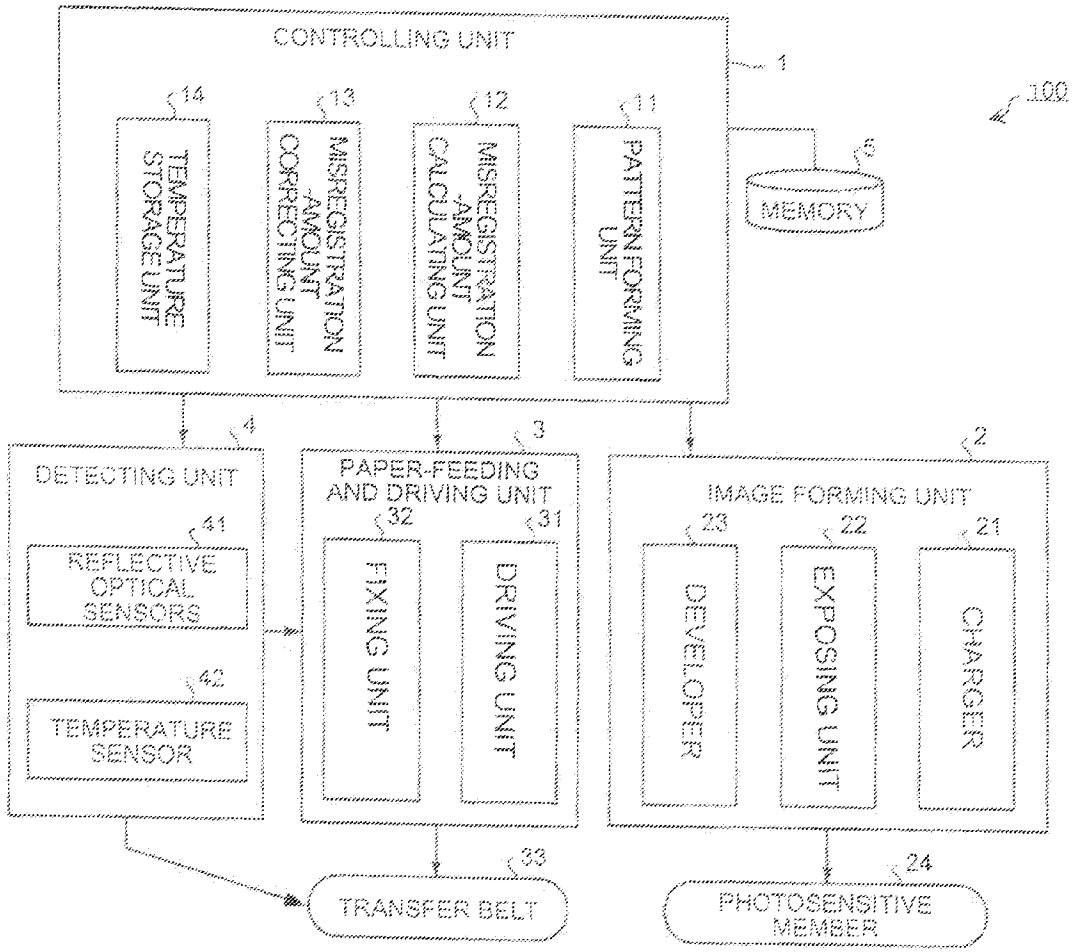
FIG. 1 is a diagram of an image forming apparatus according to a first embodiment of the present invention.

FIG. 1 is a diagram of the image forming apparatus according to a first embodiment of the present invention. An image forming apparatus 100 according to the first embodiment includes a controlling unit 1, an image forming unit 2, a paper-feeding and driving unit 3, a detecting unit 4, and a memory 5. The image forming apparatus 100 is a tandem image forming apparatus capable of image forming of a plurality of colors.

The controlling unit 1 controls overall image formation. Also, the controlling unit 1 performs a color misregistration correction process. The image forming unit 2 performs image formation under the control of the controlling unit 1. The paper-feeding and driving unit 3 conveys a sheet to the image forming unit 2 under the control of the controlling unit 1. The detecting unit 4 detects position information of a pattern for measuring a color misregistration amount, the pattern formed by the image forming unit 2. The memory 5 stores therein information about a pattern for measurement to be read when the controlling unit 1 performs a color misregistration correction process. Also, the memory 5 stores therein temperature information.

The controlling unit 1 includes a pattern forming unit 11, a misregistration-amount calculating unit 12, a misregistration-amount correcting unit 13, and a temperature storage unit 14. The pattern forming unit 11 reads the information about the pattern for measuring a color misregistration amount stored in the memory 5 to control the image forming unit 2, and causes the pattern for measuring a color misregistration amount on a transfer belt 33. The pattern for measuring a color misregistration amount (hereinafter, "a pattern for measurement") is formed on the transfer belt to measure a color misregistration amount of a plurality of colors. The temperature storage unit 14 has stored therein temperature information detected by a temperature sensor 42. The temperature storage unit 14 may store the temperature information in the memory 5. The operation of the controlling unit 1 correcting the color misregistration amount is explained further below.

The image forming unit 2 includes a charger 21, an exposing unit 22, a developer 23, and a photosensitive member 24. The image forming unit 2 performs image formation under the control of the controlling unit 1. The charger 21 electrically charges the photosensitive member 24.

The exposing unit 22 has an image-forming optical system and a rotational polygon mirror. The exposing unit 22 causes a laser beam to be generated, and irradiates, via the image-forming optical system and the rotational multi-surface mirror, the charged photosensitive member 24 with the laser beam controlled based on image data, thereby forming an electrostatic latent image corresponding to each color.

The developer 23 performs a developing process for each color according to the electrostatic latent image for each color formed on the photosensitive member 24. The developer 23 performs a developing process, for example, a process of applying toner for each color on the photosensitive member 24.

The paper-feeding and driving unit 3 has a driving unit 31, a fixing unit 32, and the transfer belt 33. The driving unit 31 causes a roller to be rotated to move the transfer belt 33. An image obtained by performing a developing process for each color by the developer 23 is transferred on the transfer belt 33 driven by the driving unit 31. The transfer belt 33 is an intermediate transfer member. The image transferred on the transfer belt 33 is further transferred on a recording sheet, and is then fixed by the fixing unit 32.

In such an image forming process, a misregistration occurs for each color due to various factors, such as temperature change in the apparatus or a mechanical deformation of each unit. As a result, a color misregistration occurs for each plate to degrade image quality. The present invention corrects such a color misregistration occurring for each plate.

The detecting unit 4 has reflective optical sensors 41 and the temperature sensor 42. The reflective optical sensors 41 detect position information for respective colors in the pattern for measurement transferred on the transfer belt 33.

In the present embodiment, the configuration is such that the pattern for measurement is formed on the transfer belt 33 for a correction process. This configuration is not meant to be restrictive. For example, the configuration may be such that the pattern for measurement is formed on a recording sheet for a correction process. In the case of the latter configuration, the reflective optical sensors 41 detect position information for respective colors in the pattern for measurement printed on the recording sheet.

The temperature sensor 42 detects the temperature in the apparatus. The temperature sensor 42 preferably detects a temperature near the exposing unit 22. In particular, exemplary temperatures to be preferably detected are a temperature of an fθ lens included in the image-forming system or an optical-beam scanning system in the exposing unit 22, and an atmospheric temperature near the fθ lens. This is because thermal deformation of these optical components may be a main reason for the occurrence of a color misregistration. The temperature storage unit 14 has stored therein the temperature detected by the temperature sensor 42.

Here, in the controlling unit 1, the pattern forming unit 11 controls the charger 21, the exposing unit 22, and the photosensitive member 24 of the image forming unit 2 to form an electrostatic latent image on the photosensitive member 24. Then, the developer 23 forms a pattern for measurement on the transfer belt 33.

The misregistration-amount calculating unit 12 receives position information for respective colors detected from the image of the pattern for measurement formed on the transfer belt 33 by the reflective optical sensors 41, and then calculates a misregistration amount from the reference value of each color image.

The misregistration-amount correcting unit 13 calculates a correction amount for correcting the misregistration amount for each color according to the misregistration amount calculated by the misregistration-amount calculating unit 12. The controlling unit 1 controls the image forming unit 2 to correct the latent image corresponding to each color to be formed on the photosensitive member 24. In this manner, the image forming apparatus according to the first embodiment corrects a deviation of a positional relation of an image set for each color, if any. Here, the position irradiated with a laser is shifted through a logic operation in both of a main scanning direction, which is laser scanning with a polygon or the like, and a sub-scanning direction which is rotating movement of the photosensitive member, thereby correcting the misregistration amount among colors on the transfer belt. Here, a color misregistration correction is performed with reference to a predetermined one color, such as black. This is because a color misregistration phenomenon represents a relative misregistration for each color, and therefore it is enough to perform a misregistration correction with reference to the predetermined one color.

Figure 2:
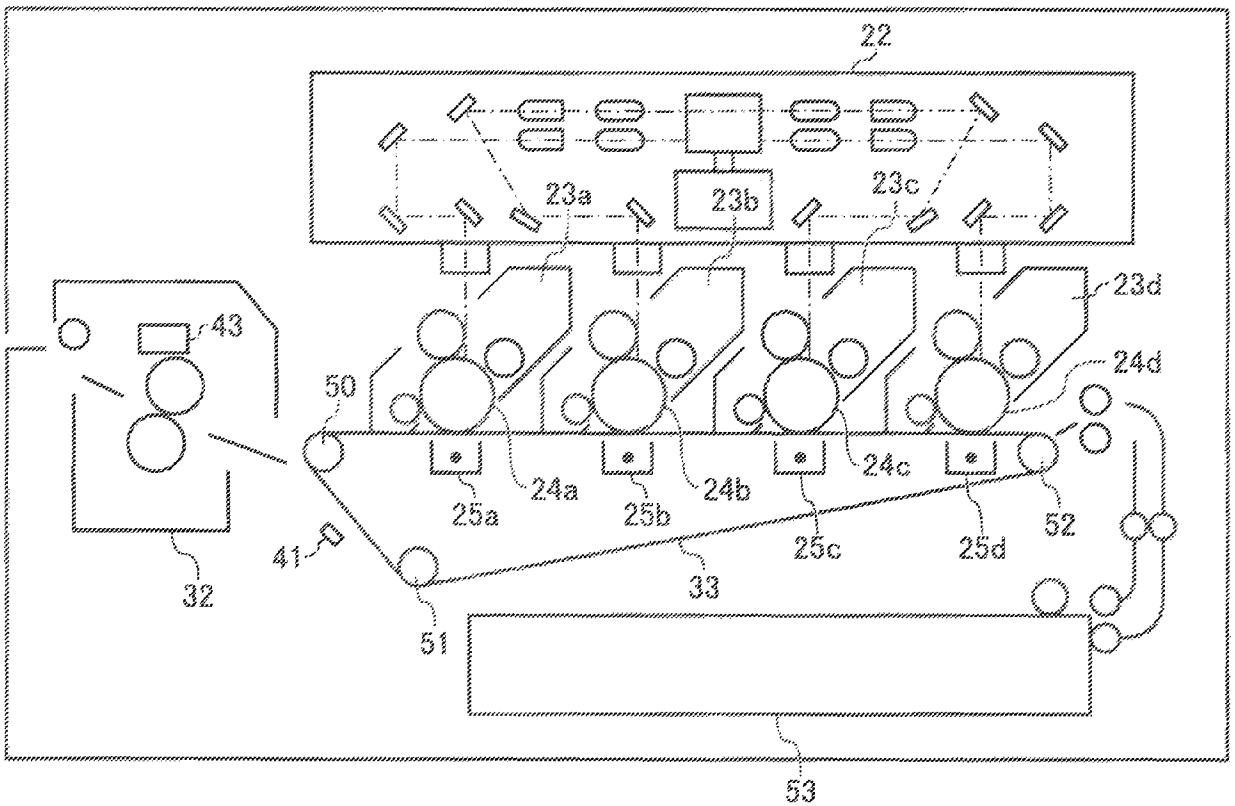
FIG. 2 is a schematic of the image forming apparatus shown in FIG. 1.

FIG. 2 is a schematic of the image forming apparatus shown in FIG. 1. The image forming apparatus is a so-called tandem image forming apparatus for image formation with a plurality of colors. Image data input to the image forming apparatus is converted to image data for color recording for respective colors including black, yellow, cyan, and magenta (hereinafter, "K, Y, C, and M"), and is then sent to the exposing unit 22.

The exposing unit 22 irradiates each of photosensitive members 24*a*, 24*b*, 24*c*, and 24*d* for K, M, C, and Y, respectively, with a beam from a laser diode (LD) as a light source, according to the image data of each color, thereby forming electrostatic latent images. The electrostatic latent images are developed by developing devices 23*a*, 23*b*, 23*c*, and 23*d*, respectively, with toner of the respective colors, thereby forming toner images for the respective colors. Images developed on four photosensitive drums are sequentially color-superposed for full-color image formation.

A transfer sheet is conveyed from a paper-feeding cassette 53 to the transfer belt 33. Transfer units 25*a*, 25*b*, 25*c*, and 25*d* sequentially transfer and superpose the toner images developed and formed on the photosensitive members 24*a* to 24*d*, respectively, on the transfer belt 33. After transferred on the transfer belt 33, the image obtained through superposition is printed on a transfer sheet. The fixing unit 32 fixes the image transferred from the transfer belt 33 onto the transfer sheet. The transfer sheet with the image being fixed by the fixing unit 32 is delivered to the outside of the apparatus.

The transfer belt 33 is formed of, for example, a translucent endless belt. The transfer belt 33 is supported by a driving roller 50, a tension roller 51, and a follower roller 52. The tension roller 51 includes a pressing unit (not shown) that gives a tension to the transfer belt 33 to keep the tension of the belt approximately constant.

The pattern for measurement for use in color misregistration correction in the image forming apparatus is formed on the transfer belt 33. The pattern for measurement formed on the transfer belt 33 moves with the driving of the driving unit 31.

The reflective optical sensors 41 detect mark positions of the moving pattern for measurement formed on the transfer belt 33. From the position information of the respective marks of the pattern for measurement detected by the reflective optical sensors 41, the misregistration-amount calculating unit 12 performs a comparison with a reference interval previously set for each color to calculate a color misregistration amount with respect to the reference interval. The misregistration-amount correcting unit 13 performs a correction process so as to cancel the misregistration amount calculated by the misregistration-amount calculating unit 12.

Figure 3:
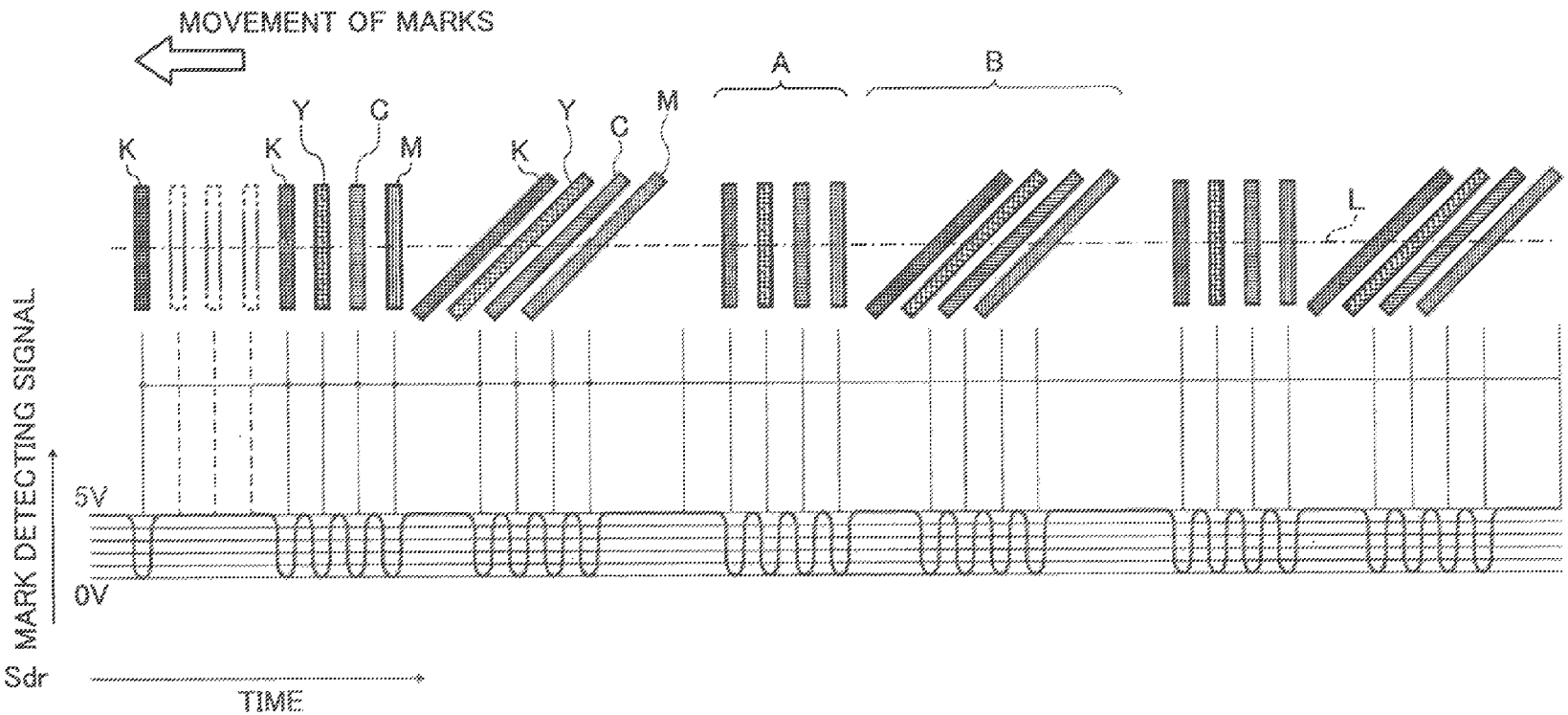
FIG. 3 is a schematic of one example of a pattern for measurement formed on a transfer belt 33 shown in FIG. 2.

FIG. 3 is a schematic of one example of a pattern for measurement formed on the transfer belt 33 shown in FIG. 2. The pattern for measurement in this example is, as depicted in FIG. 3, a pattern in which strip-shaped marks, which is a strips, for respective colors are arranged in parallel and written. The design of the pattern for measurement is not restricted to the design depicted in FIG. 3, and may be any as long as relative position information for each color can be obtained.

The pattern forming unit 11 controls the exposing unit 22 to write and develop the strip-shaped marks on each of the photosensitive members 24 at front, center, and rear in FIG. 2. As a result, the pattern for measurement is transferred on the surface of the transfer belt 33 at three positions, that is, front, center, and rear, in an axial direction of the roller. A plurality of such patterns for measurement may be formed in a sub-scanning direction, because, with a plurality of patterns for measurement being formed, the accuracy of detecting a misregistration can be increased, thereby increasing reliability. However, herein, for simplicity of explanation, only the case will be explained in which one pattern for measurement is formed in a sub-scanning direction.

The pattern for measurement is such that, as for the marks of the respective colors of M, C, Y, and K, a parallel pattern, which is a mark group denoted as A in FIG. 3, including a plurality of marks parallel to a main scanning direction, or a width direction of the transfer belt 33, and a tilted pattern, or a mark group denoted as B in FIG. 3, arranged as being tilted at a certain angle θ, for example 45 degrees, and parallel to each other with respect to the main scanning direction are formed at front, center, and rear sides, that is, on both sides and the center portion of the belt. The mark group A is for measuring the color misregistration amount in the sub-scanning direction, whilst the mark group B is for measuring a color misregistration amount in the main scanning direction.

As depicted in FIG. 3, the strip-shaped marks in the pattern for measurement are formed so as to be spaced apart from each other. Here, with reference to a black (K) mark, there is a distance between the black mark and each of the other marks. The distance between K and each of the other marks can be controlled by the pattern forming unit 11 controlling a timing of writing by the exposing unit 22 in the photosensitive member 24.

Figure 4:
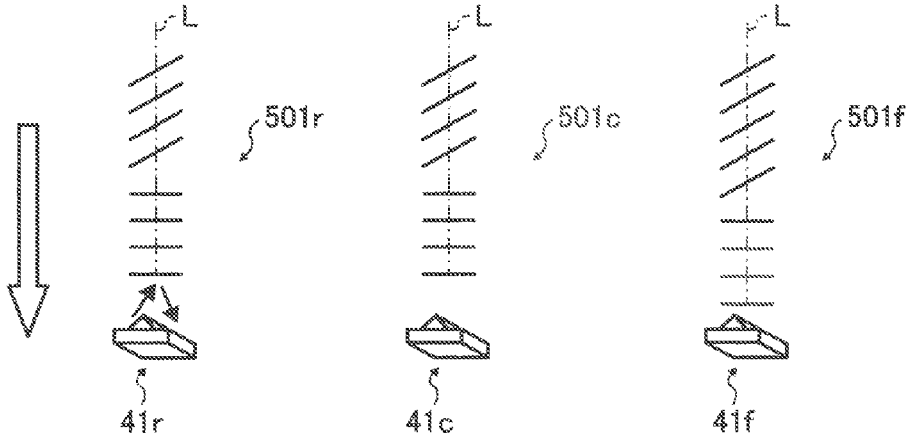
FIG. 4 is a drawing for explaining the reflective optical sensors detecting the pattern for measurement shown in FIG. 3.

FIG. 4 is a drawing for explaining the reflective optical sensors detecting the pattern for measurement shown in FIG. 3. The reflective optical sensors 41 irradiate the pattern for measurement on the transfer belt 33 with light for reflection, and then receives reflected light, thereby detecting mark position information.

Formed on the transfer belt 33 are a pattern for measurement on a front side 501*f*, a pattern for measurement on a center side 501*c*, and a pattern for measurement on a rear side 501*r*. Reflective optical sensors 41*f* which is a front side, 41*c* a center side, and 41*r* a rear side, each of which are read a distance between K and a relevant one of the other marks in the pattern for measurement on the transfer belt 33. Data of the distance of each mark with reference to K read by the relevant one of the reflective optical sensors 41*f*, 41*c*, and 41*r* is calculated at the timing of reading.

The data of the distance values detected by the reflective optical sensors 41*f*, 41*c*, and 41*r* is transmitted to the misregistration-amount calculating unit 12. The misregistration-amount calculating unit 12 compares the data of distance values obtained from K and each of the other marks and the reference value to calculate a misregistration amount for each mark.

The reflective optical sensors 41*f*, 41*c*, and 41*r* each include a light-emitting element, an integrator, an amplifier, and others, and receive, at an optical-electrical conversion element (not shown), such as a phototransistor, reflected light or translucent light coming from the transfer belt 33 through a slit (not shown). At the phototransistor, the received light causes a low impedance between the collector and the emitter, thereby increasing the emitter potential, that is, the level of the detecting signal of each reflective optical sensor 41. The magnitude of the mark detecting signal is represented as 5 volts in FIG. 3.

When the pattern for measurement moves to reach the position to be detected by each reflective optical sensor 41, the marks interrupts the light, thereby causing a high impedance between the collector and the emitter of the transistor and decreasing the emitter potential. The magnitude of the mark detecting signal is represented as 0 volts in FIG. 3. That is, the presence of each mark in the pattern for measurement is detected at a center line L drawn in FIG. 3, and with the detecting signal varied to high and low, the position of each mark of the pattern for measurement can be detected.

Figure 5:
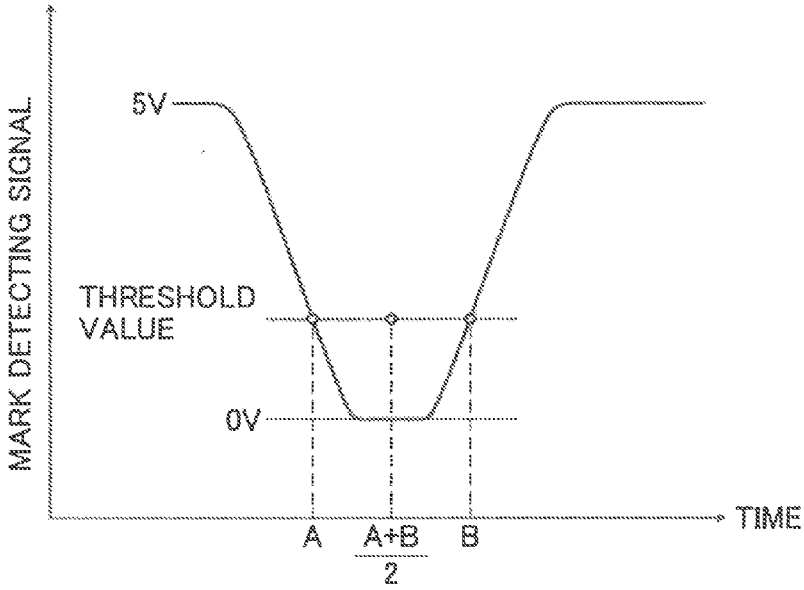
FIG. 5 is a drawing for explaining that the reflective optical sensors detect mark positions shown in FIG. 4.

FIG. 5 is a drawing for explaining that the reflective optical sensors 41 detect mark positions shown in FIG. 4. When the marks are passed, the mark detecting signal detected by the reflective optical sensor 41 is decreased, thereby drawing a curve protruding downward. Here, when threshold values are set for the mark detecting signal, a time given by these threshold values can be detected. When A and B are set as times, a midpoint (A+B)/2 indicates a time representing a midpoint in the sub-scanning direction of the marks, thereby allowing the mark positions to be calculated more accurately. However, detection of the marks can be performed with another scheme, such as a detection scheme of determining an edge region of the mark forming the pattern.

The misregistration-amount calculating unit 12 analog/digital (A/D) converts the detecting signals read by the reflective optical sensors 41 with a predetermined pitch to specify the scanning position and store it in the memory 5. The misregistration-amount calculating unit 12 performs a comparison with the set value stored in the memory 5 to calculate a misregistration amount of each mark of the pattern for measurement.

The misregistration-amount correcting unit 13 performs a correction process so as to cancel the misregistration for each color transferred on the transfer belt by using the misregistration amount obtained by the misregistration-amount calculating unit 12. The controlling unit 1 controls the exposing unit 22 to correct the image forming position for each color at an exposing stage.

Figure 6:
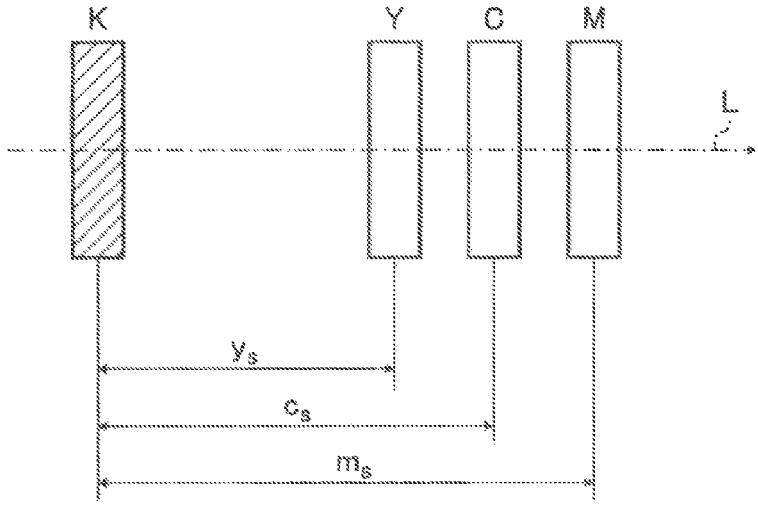
FIG. 6 is a schematic of one example of a pattern for measurement in a sub-scanning direction shown in FIG. 3.
Figure 7:
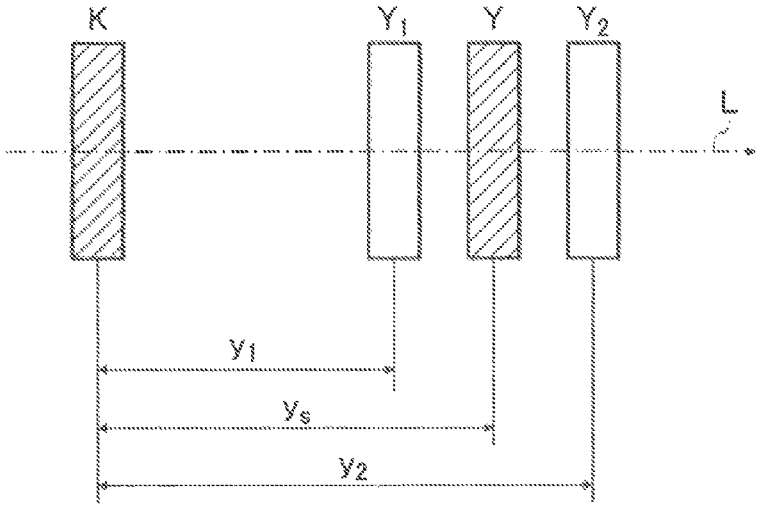
FIG. 7 is a diagram for explaining a correction of a color misregistration amount in the sub-scanning direction shown in FIG. 3.

FIG. 6 is a schematic of one example of a pattern for measurement in a sub-scanning direction shown in FIG. 3. FIG. 7 is a diagram for explaining a correction of a color misregistration-amount in the sub-scanning direction shown in FIG. 3. In the pattern for measurement, the pattern forming unit 11 counts a distance of a clock frequency less, thereby allowing the distances of the marks of the respective colors to be set shorter. Also, the pattern forming unit 11 counts the distance of the clock frequency more, thereby allowing the distances of the marks of the respective colors to be set longer.

The reflective optical sensors 41 measure the position information of each mark at a timing at the read position, thereby counting the number of clocks. The reflective optical sensors 41 detect, as depicted in FIG. 6, the respective marks K, Y, C, and M.

From the position information detected by the reflective optical sensors 41, the misregistration-amount calculating unit 12 calculates distances ys, cs, and ms from Y, C, and M, respectively, with reference to K.

In the case of correction for each color in the sub-scanning direction, as depicted in FIG. 7, a color misregistration between the mark of K and the mark of Y in the sub-scanning direction is detected through comparison in distance with the reference value. Now, it is assumed that ys is a distance between the mark of K and the mark of Y initially set as a reference. As a result of a color misregistration, the distance between the mark of K as a reference and the mark of Y may be reduced to be a distance y1. Alternatively, as a result of a color misregistration, the distance between the mark of K and the mark of Y may be extended to be a distance y1. A relation in magnitude between the distances is $$y1<ys<y2.$$

The distance between K and Y is measured on the center line L. The center line L is parallel to the sub-scanning direction.

The reflective optical sensors 41 obtain position information of the marks of not only Y but also the other colors with reference to K in the sub-scanning direction. The obtained position information of the marks of the respective colors is transmitted to the misregistration-amount calculating unit 12.

When the distance between K and Y is y1, for example, the misregistration-amount correcting unit 13 multiplies the timing of counting and writing the number of clocks by ys/y1, thereby correcting the state where the distance is reduced to cause a misregistration to the state as a reference. Also, when the distance between K and Y is y2, the misregistration-amount correcting unit 13 multiplies the timing of counting and writing the number of clocks by ys/y2, thereby correcting the state where the distance is extended to cause a misregistration to the state as a reference.

Figure 8:
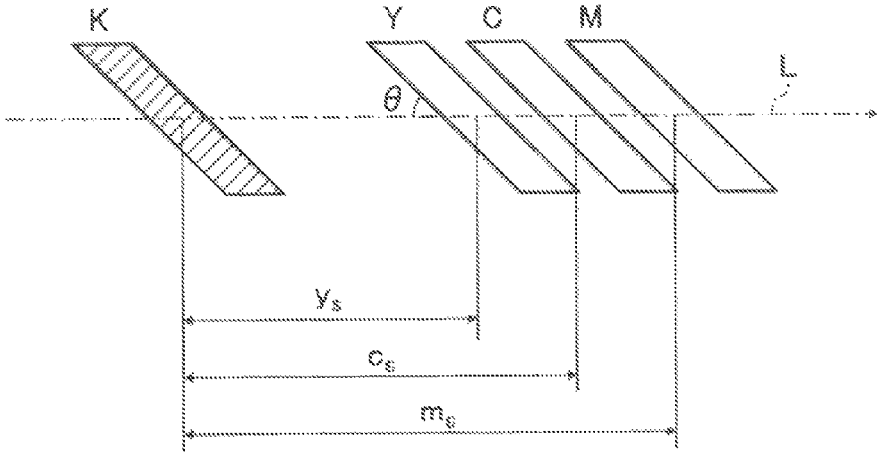
FIG. 8 is a schematic of one example of a pattern for measurement in a main scanning direction shown in FIG. 3.

FIG. 8 is a schematic of one example of a pattern for measurement in a main scanning direction shown in FIG. 3.

Figure 9:
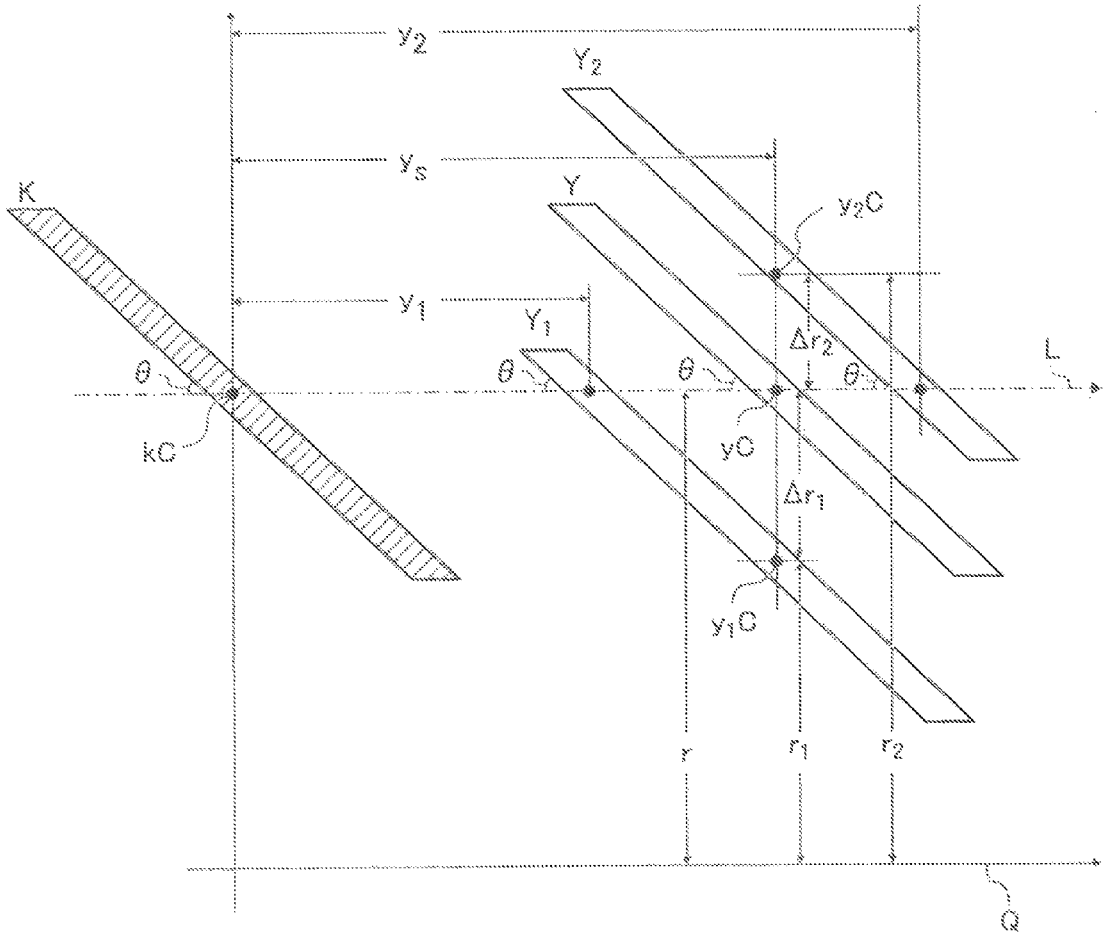
FIG. 9 is a diagram for explaining correction of a color misregistration amount in the main-scanning direction shown in FIG. 3.

FIG. 9 is a diagram for explaining correction of a color misregistration amount in the main scanning direction shown in FIG. 3. As depicted in FIG. 8, the pattern for measurement for detecting a misregistration in the main scanning direction is configured as strip-shaped marks drawn as being tilted with respect to the moving direction of the transfer belt 33 and being parallel to one another. A tilted angle θ is a predetermined angle, for example, 45 degrees. The reflective optical sensors 41 calculate the distances ys, cs, and ms with reference to K from the position information of the respective marks K, Y, C, and M. Each of the distances above is measured on the center line L.

Now, calculating a color misregistration amount in the main scanning direction with a color misregistration amount in the sub-scanning direction is explained. As for a color misregistration between the mark of K and the mark of another color, for example, the mark of Y, in the main scanning direction, as depicted in FIG. 9, when Y is assumed to represent a reference position, Y1 and Y2 represent marks drawn as being shifted in the main scanning direction. With Y1 and Y2 being shifted in the main scanning directions, points crossing the center line L of the pattern moves in the sub-scanning direction.

FIG. 9 depicts the sate where the mark represented by Y does not have a misregistration with respect to the mark of K in the main scanning direction. Here, ys represents a distance between a point where Y as a reference crosses L to a point where K crosses L. That is, ys represents a distance between the mark of K initially set as a reference and the mark of Y.

Q represents a line passing through the center in the main scanning direction in the transfer belt. When the mark Y is shifted in the main scanning direction to be formed as Y1 or Y2, since it is formed at an angle tilted with respect to the main scanning direction, this misregistration is detected on the center line L as a misregistration on the sub-scanning direction.

Now, a distance between a center yC of the mark Y and Q is r. Here, a mark Y1 is formed by being shifted downward in the drawing, whilst a mark Y2 is formed by being shifted upward in the drawing. Center points of the marks Y1 and Y2 in the main scanning direction and the sub-scanning direction are represented as y1C and y2C. Misregistration of the marks in the main scanning direction are represented as Δr1 and Δr2, as depicted in the drawing. Also, for the respective marks, a distance from the line Q to the center point y1C is r1, a distance from the line Q to the center yC, which is the center point of the mark Y, is r, and a distance from the line Q to y2C is r2. Here, r is a constant value because it represents a reference value. Also, a misregistration amount Δr is 0.

Now, it is assumed that the reflective optical sensors 41 detect the position information of the marks Y1, Y, and Y2 in the sub-scanning direction on the center line L of the pattern for measurement as y1, ys, and y2, respectively.

Here, a relation among the detected values can be represented in the following equations.

$$\tan\theta=\Delta r1/(y1-ys)=\Delta r2/(y2-ys)=\text{constant value} \quad \text{(Equation 1)}$$

$$\Delta r1=r1-rs,\ \Delta r2=r2-rs \quad \text{(Equation 2)}$$

As explained above, the misregistration-amount calculating unit 12 can calculate the distances y1, ys, and y2 depicted in the drawing. Also, θ and r are set reference values and are known. Accordingly, Δr1 and Δr2 are calculated from Equation 1.

Furthermore, r1 and r2 are calculated from Equation 2. Therefore, it is calculated at Y1 that image formation has been made as being drawn in a direction of the center line Q by r1/r. Also, it is calculated at Y2 that image formation has been made as being drawn away in a direction of the center line Q by r2/r.

The misregistration-amount correcting unit 13 can correct these misregistration amount so as to cancel them. That is, for Y1, a correction is made so as to extend the distance between pixels by r/r1. Also, for Y2, a correction is made so as to compress the distance between pixels by r/r2. In this manner, a misregistration amount correction in the main scanning direction can be performed.

From the position information of each mark in the pattern for measurement read by the reflective optical sensors 41, the misregistration-amount calculating unit 12 detects a misregistration due to a deviation in write timing of the exposing unit 22 on each photosensitive member 24. Then, the misregistration-amount correcting unit 13 corrects the write timing by counting the clock frequency so as to cancel the misregistration due to the deviation in write timing, thereby correcting a writing operation of the exposing unit 22 on each photosensitive member 24.

However, the misregistration in the sub-scanning direction detected for calculating a misregistration in the main scanning direction original includes a misregistration amount resulting from a misregistration in the sub-scanning direction, and therefore has to be corrected. Here, however, for simplification of explanation, such a correction is not explained.

Also, an actual misregistration amount includes both of the misregistration in the sub-scanning direction and the misregistration in the main scanning direction. Therefore, in the operations of calculating a misregistration amount and correcting the misregistration amount, the misregistration amount can be calculated and corrected by combining the misregistration amounts in both directions. Furthermore, the scheme of detecting the misregistration amount in the main scanning direction and the sub-scanning direction is not restricted to the scheme explained above.

In this manner, when the image forming apparatus is operated for the first time, for example, the temperature in the apparatus at the time of a color misregistration correction has not yet been stored. Only in that case, a color misregistration correction is automatically performed at the same time when the apparatus is powered on. The temperature sensor 42 detects the temperature in the apparatus detected at the time of a color misregistration correction performed at the time of power-on. The temperature storage unit 14 has stored therein a temperature difference in the apparatus detected by the temperature sensor 42.

The misregistration-amount calculating unit 12 compares, for each predetermined time elapsing, the temperature in the apparatus detected by the temperature sensor 42 and the temperature in the apparatus stored in the temperature storage unit 14 and, when a temperature difference is equal to or larger than a predetermined value, performs a color misregistration correction again. The temperature storage unit 14 stores the temperature value in the apparatus detected by the temperature sensor 42 at this time for update. The temperature stored in the temperature storage unit 14 for update serves as a reference temperature for determining whether to perform a further color misregistration correcting operation.

Figures 10, 10A, 10B:
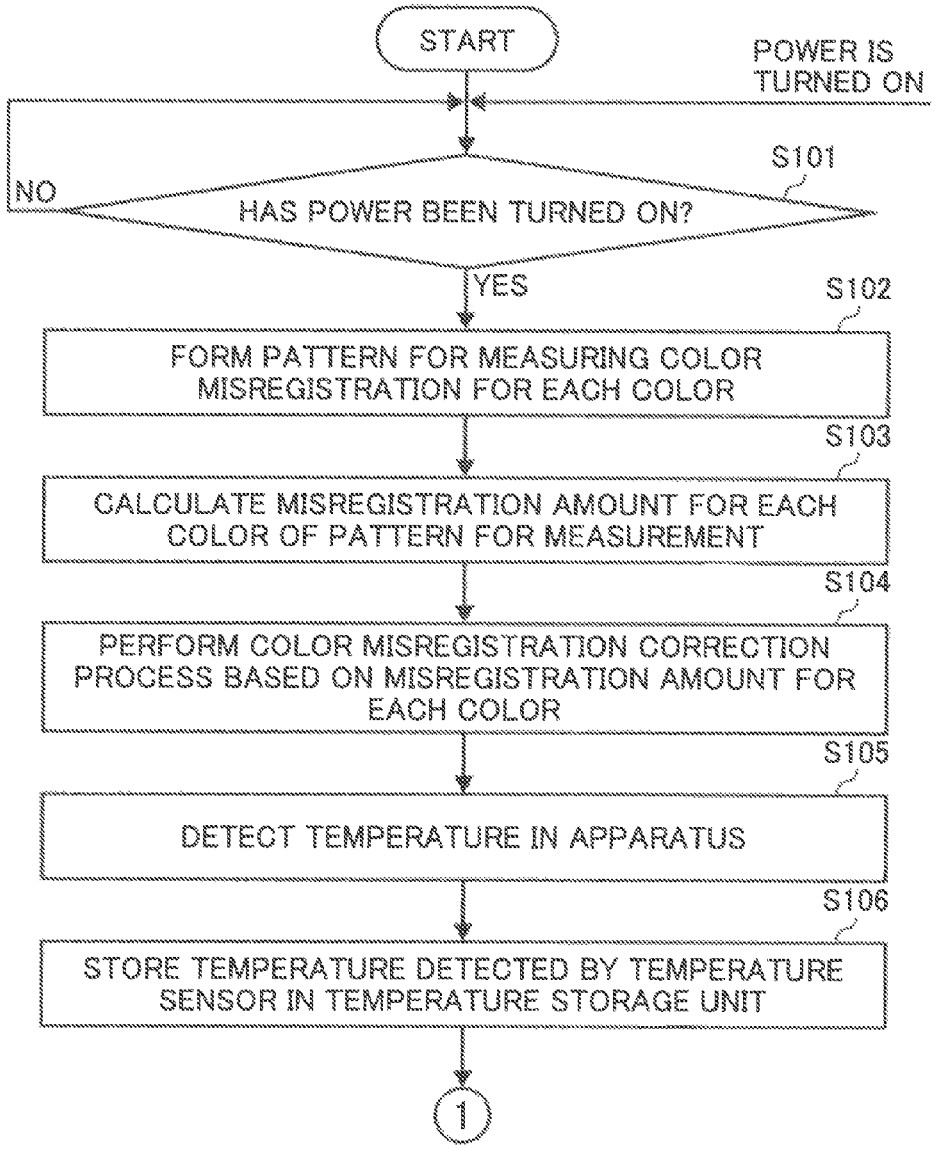
FIG. 10 is a flowchart for explaining a color misregistration correction and storing a detected temperature according to the first embodiment.
Figure 10B:
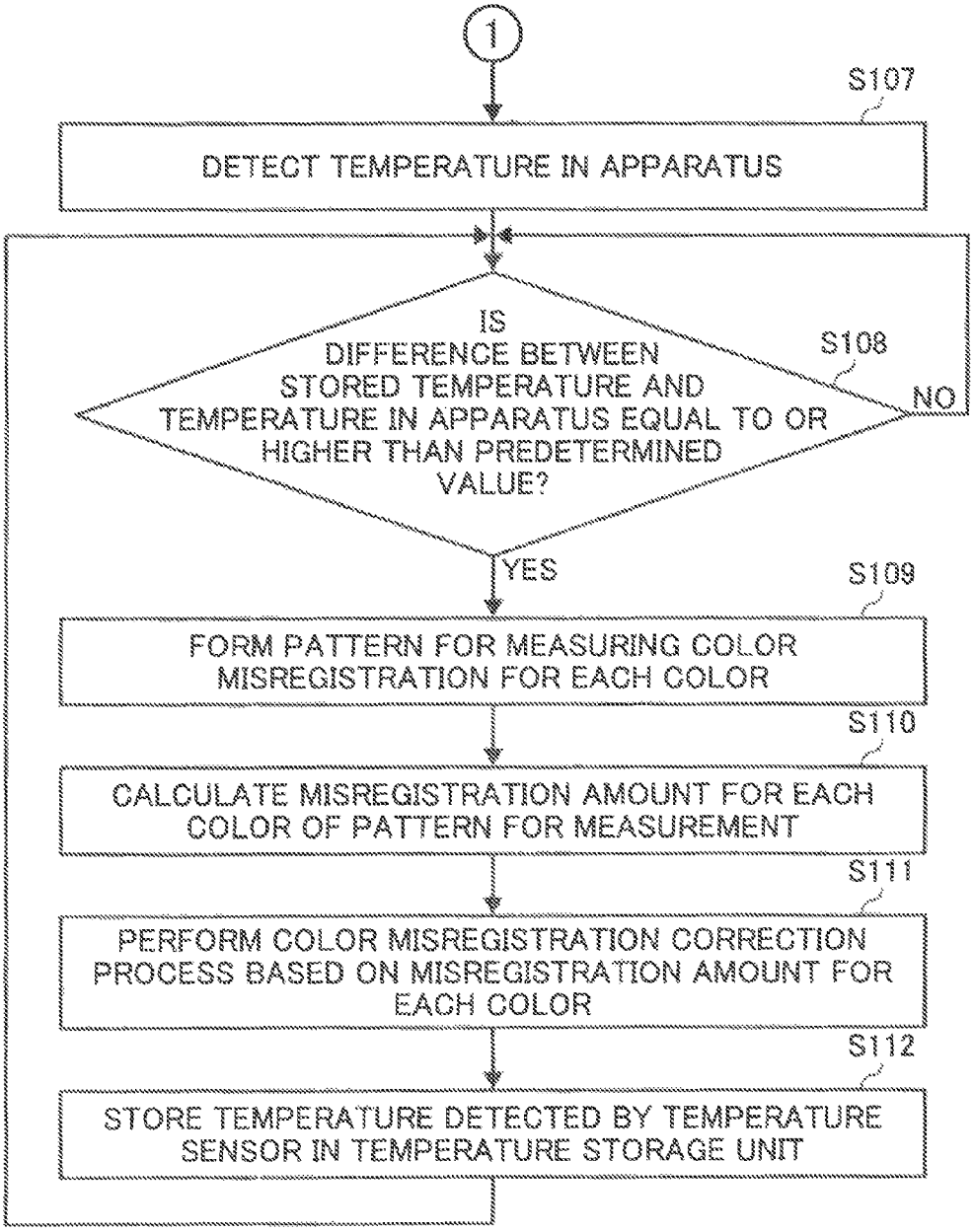

FIG. 10 is a flowchart for explaining a color misregistration correction and storing a detected temperature value according to the first embodiment. Here, when an apparatus temperature is not stored in the temperature storage unit 14, such as the case where the apparatus itself is installed for the first time, a color misregistration correction process is first performed at the time of power-on, and the temperature in the apparatus at this time is detected for storage. Furthermore, when a color misregistration correction is thereafter performed, the detected temperature is stored.

The misregistration-amount calculating unit 12 determines whether power is turned on (step S101). When determining that power has been turned on ("Yes" at step S101), the misregistration-amount calculating unit 12 reads information about the pattern for measuring a color misregistration for each color and transmits the information to the exposing unit 22. The exposing unit 22 irradiates the photosensitive member 24 charged by the charger 21 with a laser beam according to the information about the pattern for measurement to form electrostatic latent images. The developer 23 performs a developing process on the electrostatic latent images corresponding to the respective colors, and then transfers the pattern for measurement on the transfer belt 33. In this manner, the pattern for measuring a color misregistration for each color is formed on the transfer belt 33. Thus, the image forming apparatus starts a color misregistration correcting operation at the same time when power is turned on (step S102).

The pattern for measurement for each color formed on the transfer belt 33 is moved as the transfer belt 33 is conveyed by a roller driven by the driving unit 31. The reflective optical sensors 41 detect the marks of the respective colors other than K with reference to K, on the center line L of each pattern for measurement. Here, the reflective optical sensors 41 detect the position information of the respective marks as distances in the sub-scanning direction on the center line of the pattern for measurement. As explained above, by detecting such position information in the sub-scanning direction, the misregistration-amount calculating unit 12 calculates a misregistration amount in both of the main scanning direction and the sub-scanning direction (step S103).

The misregistration-amount correcting unit 13 uses the misregistration amount for each color calculated by the misregistration-amount calculating unit 12 and distance information as a reference already stored in the memory 5 to perform a correction process of correcting the misregistration amount for each color. With the misregistration-amount correcting unit 13 correcting the color misregistration amount for each color, the controlling unit 1 controls the image forming unit 2 to form a corrected image (step S104).

At this time, when the misregistration-amount correcting unit 13 performs a color misregistration correction process, the temperature sensor 42 detects the temperature in the apparatus (step S105). The misregistration-amount correcting unit 13 stores the temperature in the apparatus detected by the temperature sensor 42 in the temperature storage unit 14. The temperature storage unit 14 has stored therein the temperature in the apparatus because the temperature in the apparatus is used as a reference for determining a temperature difference from the detected temperature (step S106). When a color misregistration correction process is performed, the apparatus temperature is always detected for storage. Although detection of the apparatus temperature is performed at step S105 after the color misregistration correction process, but this may be performed before the color misregistration correction process, that is, immediately after step S101. The steps S101 to S106 explained above are a procedure when no apparatus temperature has yet been stored in the temperature storage unit 14, the procedure of once performing a color misregistration correction process and detecting the temperature in the apparatus at this time for storage.

Next, after the color misregistration correction performed at the time of the initial power-on, a temperature change with time is determined to perform a color misregistration correction. In this case, a new detected temperature is stored every time a correction is performed. That is, the temperature sensor 42 detects the temperature in the apparatus for each predetermined time (step S107). When the temperature sensor 42 detects the temperature, the misregistration-amount calculating unit 12 reads, for comparison, the temperature at the time of performing the color misregistration correction stored in the memory 5 (step S108).

When determining that the temperature difference is equal to or larger than a predetermined value as a result of comparison (Yes at step S108), the misregistration-amount calculating unit 12 reads the information about the pattern for measurement of the respective colors from the memory 5, and then enters an operation of forming a pattern for measurement on the transfer belt (step S109). This operation is similar to that at step S102, and therefore is not explained in detail.

The misregistration-amount calculating unit 12 calculates a misregistration amount for each color in the pattern for measurement (step S110). This operation is similar to that at step S103, and therefore is not explained in detail. Furthermore, the misregistration-amount correcting unit 13 performs a color misregistration correction process based on the respective color misregistration amounts (step S111). This operation is similar to that at step S104, and therefore is not explained in detail.

In this manner, when a color misregistration correction process is performed through steps S109 to S111, the misregistration-amount correcting unit 13 stores temperature value of the apparatus detected by the temperature sensor 42 at step S107 in the temperature storage unit 14 (step S112). When a color misregistration correction process is performed, the apparatus temperature is always detected for storage, because this is used as a reference for measuring a change in the apparatus temperature next time. Then, the procedure goes back again to step S107, where the temperature change with time is compared with reference to the apparatus temperature newly stored for determination and, when the temperature difference is equal to or larger than the predetermined value, a color misregistration correcting operation is repeated. In this manner, the latest detected temperature is always stored in the temperature storage unit 14, and is used for the color misregistration correction procedure according to the first embodiment explained in the following.

As explained above, when the apparatus is powered on, the image forming apparatus according to the first embodiment reads the apparatus temperature value stored at the time of the color misregistration correcting operation performed last time after power is turned on the previous time, compares the apparatus temperature at the time of power-on this time with the read value, and when the temperature difference obtained as a result of comparison is equal to or larger than the predetermined value, performs a color misregistration correction process. This determination whether to perform a color misregistration correction process is performed immediately after power is turned on.

Figure 11:
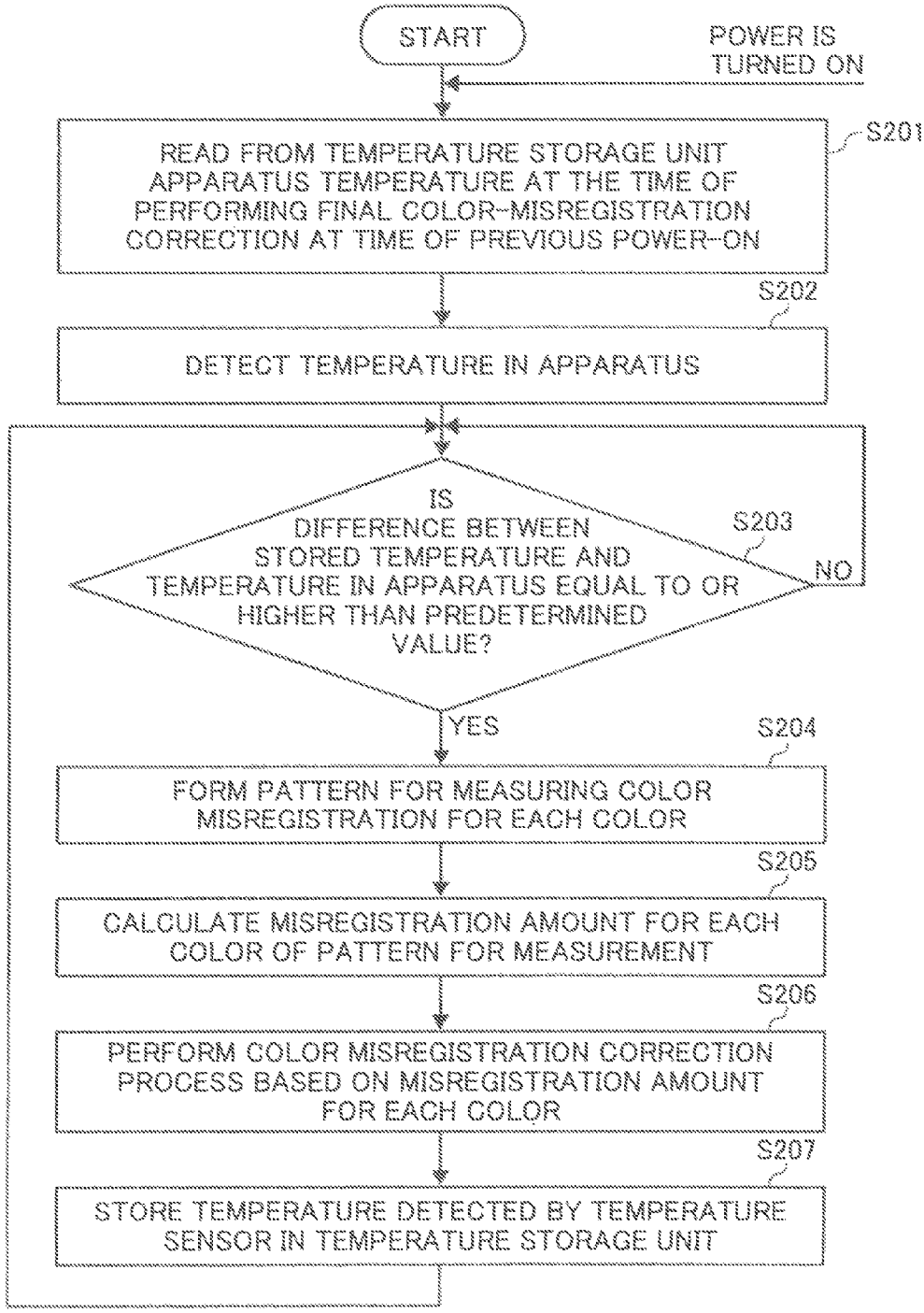
FIG. 11 is a flowchart for explaining a color misregistration correction according to the first embodiment.

FIG. 11 is a flowchart for explaining a color misregistration correction according to the first embodiment. When the image forming apparatus is powered on, the apparatus temperature at the time of performing the color misregistration correction last time at the time of power-on the previous time is read from the temperature storage unit 14 (step S201). Next, the temperature sensor 42 detects the temperature inside of the apparatus (step S202).

The misregistration-amount calculating unit 12 determines whether a difference between the apparatus temperature at the time of performing the last color misregistration correction the previous time read from the temperature storage unit 14 and the temperature in the apparatus detected by the temperature sensor 42 this time is equal to or larger than a predetermined value (step S203). When it is not determined that the difference is equal to or larger than the predetermined value (No at step S203), the procedure waits as it is without starting a correcting operation, and the temperature sensor 42 detects the temperature in the apparatus for a predetermined time (step S202).

On the other hand, when the misregistration-amount calculating unit 12 determines that the temperature difference between the temperature stored the previous time and the temperature at the time of power-on this time is equal to or larger than the predetermined value (Yes at step S203), the pattern forming unit 11 forms a pattern for measuring a color misregistration for each color (step S204). The misregistration-amount calculating unit 12 calculates a misregistration amount for each color from the position information of each color of the pattern for measurement (step S205). The misregistration-amount correcting unit 13 performs a color misregistration correction process based on the misregistration amount for each color (step S206). The temperature storage unit 14 stores the apparatus temperature detected by the temperature sensor 42 for update (step S207). These steps S204 to S207 are similar to steps S109 to S112 in FIG. 10 already explained above, and are therefore not explained in detail. Also, step S207 is similar to step S106 in FIG. 10, and is therefore not explained in detail.

In this manner, in the image forming apparatus according to the first embodiment, when power is turned on, if the difference between the apparatus temperature stored at the time of performing the color misregistration correction process last time at the time of power-on the previous time and the apparatus temperature at the time of power-on this time is smaller than the predetermined value, execution of a color misregistration correcting operation is omitted. Only when this temperature difference is equal to or larger than the predetermined value, a color misregistration correction process is performed, thereby omitting a color misregistration correcting operation when no significant temperature difference is present, reducing an initialization time, and reducing a load due to the operation of the image forming system. As a result, the life of the image forming apparatus itself can be extended.

That is, with reference to the temperature in the apparatus detected and stored at the time of the color misregistration correction, only when the temperature difference from the temperature in the apparatus detected thereafter is equal to or larger than the predetermined value, a color misregistration correction is performed. Thus, since a color misregistration correction is performed only when the temperature in the apparatus, which is often a main reason for a color misregistration, is changed over a predetermined range, an appropriate and unwasteful color misregistration correction can be performed.

Also, when a color misregistration correction is performed, the detected temperature in the apparatus is always stored for update as a reference temperature for determining the temperature difference. With this, before a color misregistration correction is performed, the temperature in the apparatus, which is a main reason for a color misregistration, is considered with reference to the temperature in the apparatus at the time of the immediately-preceding color misregistration correction. Thus, an appropriate and unwasteful color misregistration correction can be performed. With such an appropriate and unwasteful color misregistration correcting operation, unnecessary power and resource consumption can be suppressed. At the same time, a high-quality image with a color misregistration correction can be formed.

Figure 12:
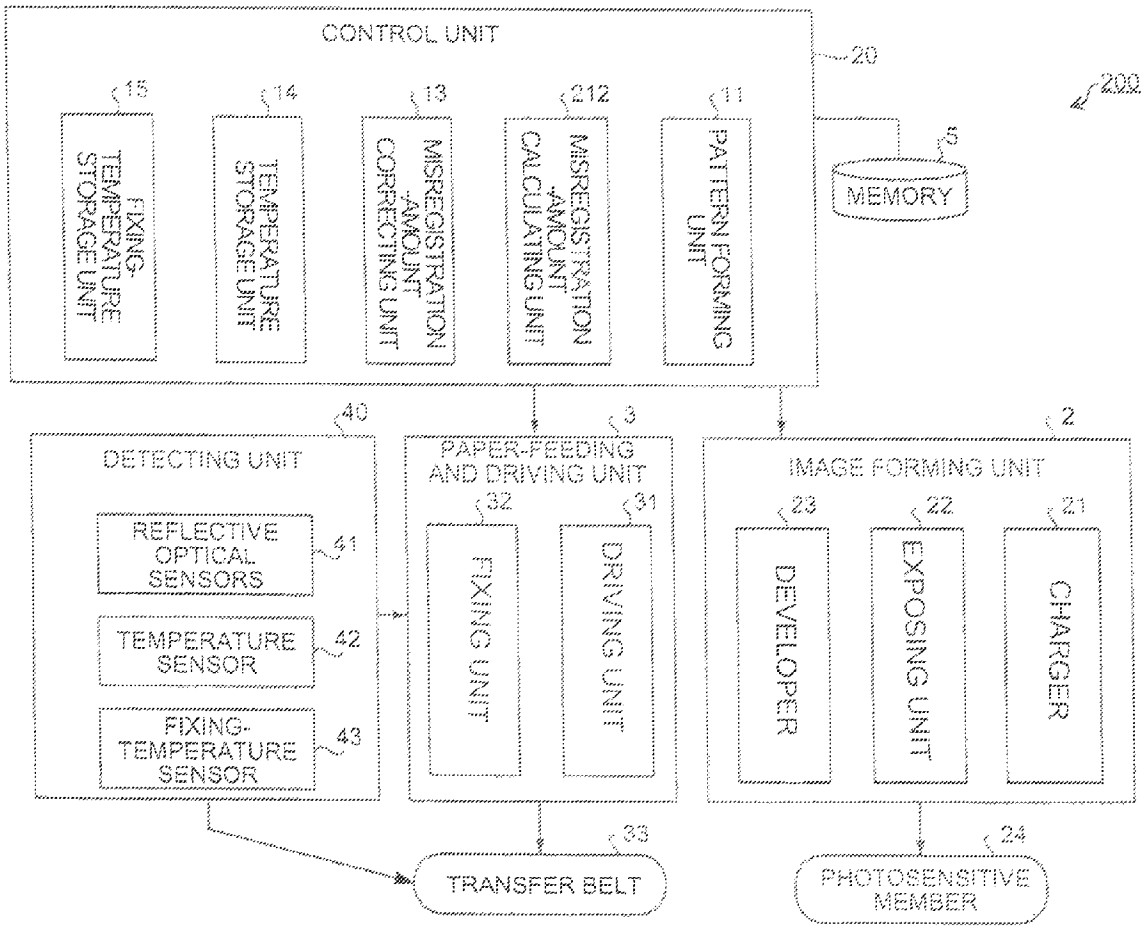
FIG. 12 is a diagram of an image forming apparatus according to a second embodiment of the present invention.

FIG. 12 is a diagram of an image forming apparatus according to a second embodiment of the present invention. In the image forming apparatus according to the second embodiment, a controlling unit 20 further includes a fixing-temperature storage unit 15, and a detecting unit 40 further includes a fixing temperature sensor 43.

The fixing-temperature sensor 43 detects the temperature of the fixing unit 32. The fixing-temperature storage unit 15 has stored therein the temperature of the fixing unit 32 detected by the fixing-temperature sensor 43. A misregistration-amount calculating unit 212 compares the fixing temperature stored in the fixing-temperature storage unit 15 and the fixing temperature detected by the fixing-temperature sensor 43 to determine a temperature difference. Also, the misregistration-amount calculating unit 212 determines a temperature difference between the apparatus temperature measured by the temperature sensor 42 and the apparatus temperature already stored.

The image forming apparatus according to the second embodiment is different from the image forming apparatus according to the first embodiment in that, at the same time when the apparatus is powered on, the fixing-temperature sensor 43 detects the fixing surface temperature of the fixing unit 32, the misregistration-amount calculating unit 212 compares the fixing temperature stored last time in the fixing-temperature storage unit 15 at the time of the previous power-on and the temperature of the fixing unit 32 detected this time by the fixing-temperature sensor 43, and only when this temperature difference is equal to or larger than a predetermined value, an initial color misregistration correction is automatically performed at the time of power-on.

The fixing-temperature sensor 43 preferably measures the surface temperature when the fixing unit 32 performs a fixing operation on the recording medium. However, the fixing temperature has a general characteristic in which it only requires to be detected once at the time of image output, and thereafter does not change much as long as the apparatus is powered on. Therefore, the fixing temperature is not required to be detected as frequently as the temperature in the apparatus is detected at predetermined intervals by the temperature sensor 42. For this reason, can be taken a scheme of detecting the fixing temperature once an image output is performed after power is turned on.

Figure 13A:
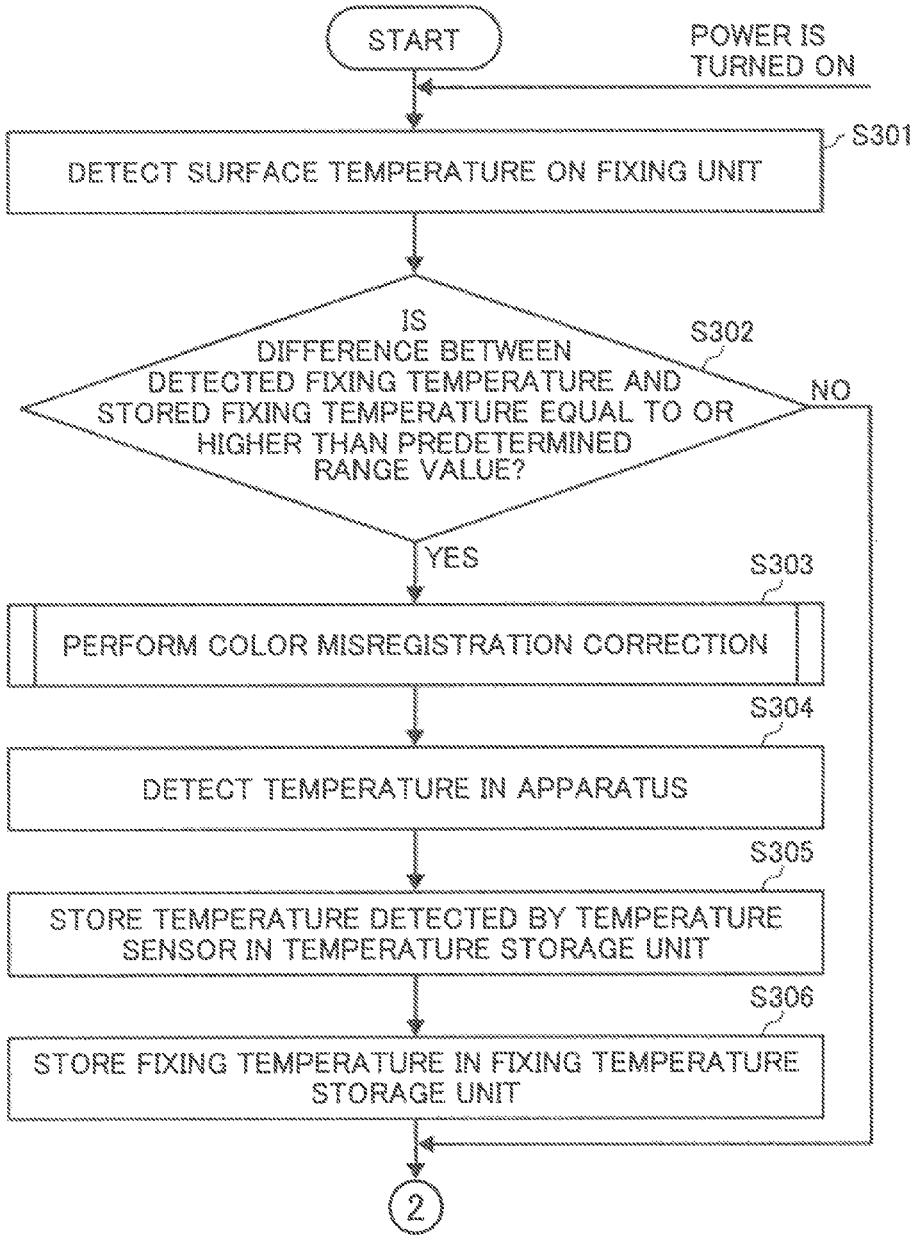
FIG. 13 is a flowchart for explaining a color misregistration correction according to the second embodiment.
Figure 13B:
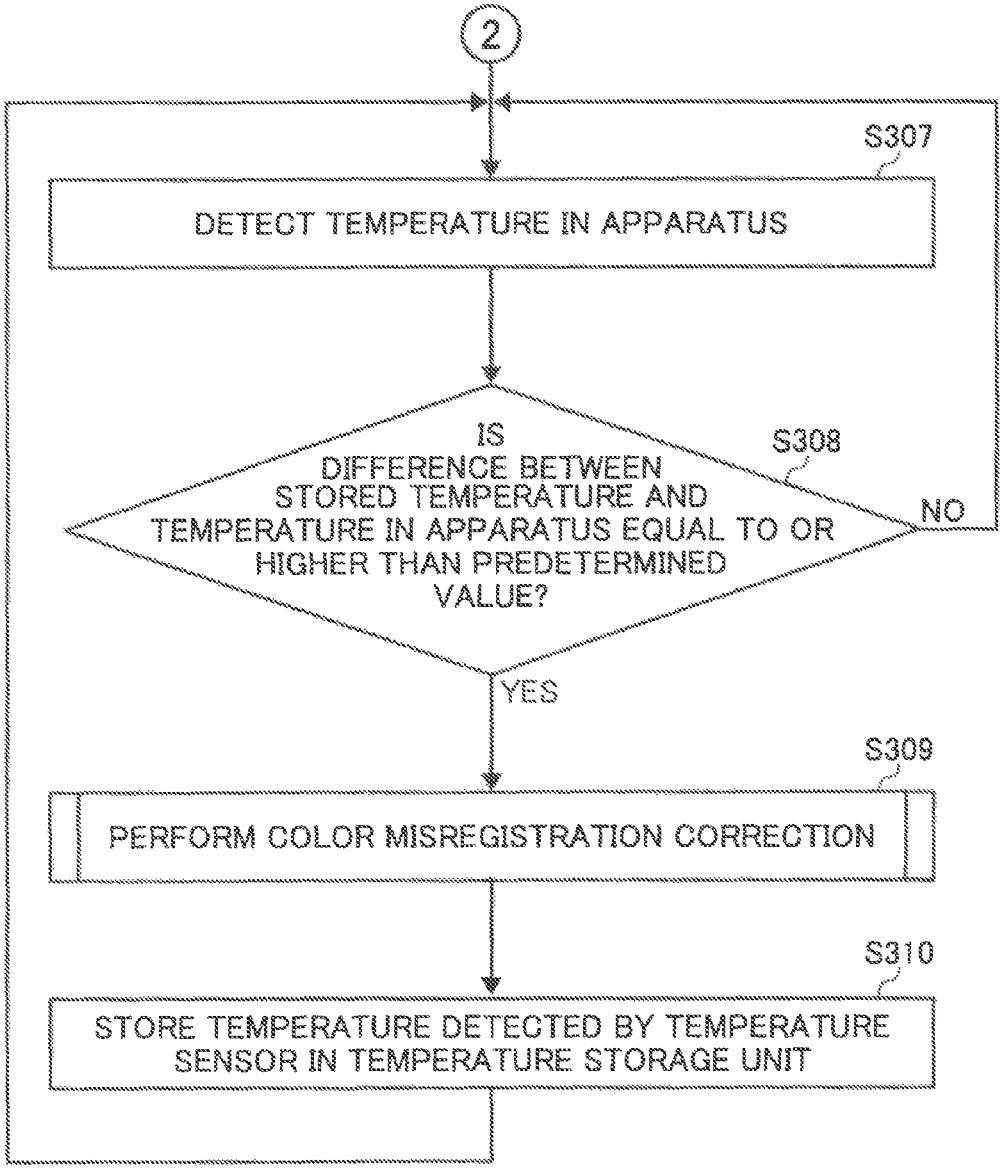

FIG. 13 is a flowchart for explaining a color misregistration correction according to the second embodiment. At the same time when power is turned on, the fixing-temperature sensor 43 detects the surface temperature with which the fixing unit 32 performs a fixing operation on the recording sheet (step S301). The misregistration-amount calculating unit 212 determines whether a difference between the fixing temperature detected by the fixing-temperature sensor 43 and the fixing temperature stored in the fixing-temperature storage unit 15 is within a predetermined range (step S302). Here, the fixing-temperature storage unit 15 has stored there the fixing temperature detected at the time of power-on the previous time. Determination whether the difference in fixing temperature is within the predetermined range is performed to determine whether to perform a color misregistration correction depending on whether the temperature is within the range in the case where different temperature ranges are set for different modes of image formation. Here, instead of the difference between the fixing temperature detected by the fixing-temperature sensor 43 and the fixing temperature stored in the fixing-temperature storage unit 15, it may be determined whether a difference between the temperature in the apparatus detected by the temperature sensor 42 and the temperature in the apparatus stored in the temperature storage unit 14 is within a predetermined range. Also, it may be determined whether any one of these differences is within a predetermined range.

When determining that the temperature difference is equal to or larger than the predetermined range (Yes at step S302), the misregistration-amount calculating unit 212 performs an initial color misregistration correction at the time of power-on. That is, the controlling unit 20 performs a color misregistration correction (step S303) the temperature sensor 42 detects the temperature in the apparatus (step S304), and the misregistration-amount correcting unit 13 stores the temperature in the apparatus detected at step S304 in the temperature storage unit 14 for update (step S305). Here, steps S303 to S305 for an initial color misregistration correction at the time of power-on are similar to steps S102 to S106 in the first embodiment, and are therefore not explained in detail. Also, detection of the temperature in the apparatus by the temperature sensor 42 may be performed before a color misregistration correction (step S303).

In the second embodiment, the fixing-temperature storage unit 15 has stored therein the temperature of the fixing unit 32 detected at step S301 by the fixing-temperature sensor 43 (step S306). This is because the temperature is compared with a fixing temperature detected when power is turned on next time.

The above is the initial color misregistration correction procedure. When the misregistration-amount calculating unit 212 determines at step S302 that the temperature difference between the previous temperature at the fixing unit 32 and the temperature at the time of power-on this time is smaller than the predetermined range value (No at step S302), it is determined that a color misregistration correcting operation is not required, thereby omitting the color misregistration correcting operation, and then the procedure goes to step S307.

Next, in a normal color misregistration correction after the apparatus is started, a change in the apparatus temperature occurring with time is determined for a color misregistration correction process. The normal color misregistration correction process at steps S307 to S310 is similar to the color misregistration correction process at the time of normal operation at steps S107 to S112 in the first embodiment, and are therefore not explained in detail.

In this manner, in the image forming apparatus according to the second embodiment, the temperature near the fixing unit 32 is measured at the time of power-on; the temperature is compared with the final fixing temperature stored at the time of power-on the previous time; only when a temperature difference therebetween is equal to or larger than a predetermined value, a color misregistration correction process is performed; and when the fixing-temperature difference does not reach the predetermined value, a color misregistration correction process is not performed. With this, the initialization time of the apparatus can be reduced, and the load due to the operation of the image forming system can be reduced. As a result, only when the temperature difference is equal to or larger than the predetermined value and when a color misregistration correction is require, an initial color misregistration correction at the time of power-on is performed. Therefore, with the load on the image forming apparatus being reduced, the life of the image forming apparatus itself can be extended.

Also, as for the apparatus temperature, irrespectively of the magnitude of the temperature change of the optical system, when the temperature difference of another area in the apparatus, that is, the fixing unit 32, is equal to or larger than the predetermined value, a color misregistration correction process is performed. With this, an appropriate color misregistration correction can be performed.

An image forming apparatus according to a third embodiment is different from that according to the second embodiment in that an initial color misregistration correction at the time of power-on is performed only when the temperature of the fixing unit 32 is low. That is, only when the fixing temperature is lower than a predetermined value immediately after power-on this time, the state is different from the state where the color misregistration correction was performed last time, and therefore a color misregistration correction be performed.

A reason is as follows. When a color misregistration correction is performed at the time of power-on the previous time, this color misregistration correction is in a state with an increased fixing temperature. If the fixing temperature immediately after power-on this time is not so low, a color misregistration correction process is not required to be performed. It is enough to perform a color misregistration correction process only when the fixing temperature is cool.

Figure 14:
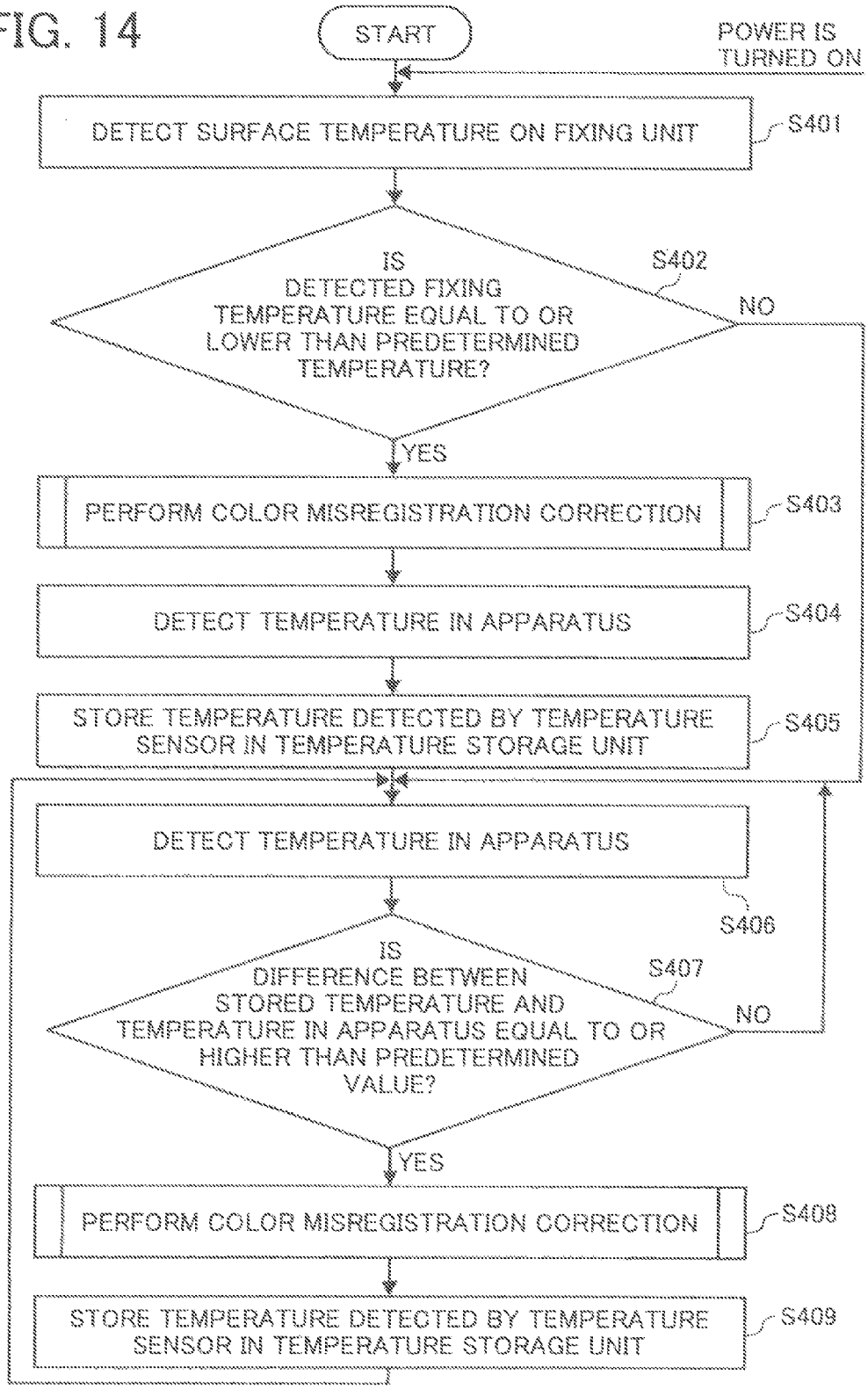
FIG. 14 is a flowchart for explaining a color misregistration correction according to a third embodiment of the present invention.

FIG. 14 is a flowchart for explaining a color misregistration correction according to a third embodiment of the present invention. When the image forming apparatus is powered on, the fixing-temperature sensor 43 detects the surface temperature at the fixing unit 32 (step S401). The misregistration-amount calculating unit 212 determines whether the detected fixing temperature is equal to or lower than a predetermined temperature (step S402). When it is determined that the fixing temperature is equal to or lower than the predetermined temperature (Yes at step S402), the controlling unit 20 performs a color misregistration correction (step S403). The temperature sensor 42 then detects the temperature in the apparatus (step S404). The misregistration-amount correcting unit 13 stores the temperature value in the apparatus detected by the temperature sensor 42 in the temperature storage unit 14 (step S405). Of this procedure, steps S403 to S405 are similar to steps S303 to S305 according to the second embodiment, and are therefore not explained in detail.

On the other hand, when determining that the detected fixing temperature is not equal to or lower than the predetermined temperature (No at step S402), the misregistration-amount calculating unit 212 does not perform an initial color misregistration correcting operation immediately after power-on, and the procedure goes to step S406.

The steps explained above form the initial color misregistration correcting operation immediately after the image forming apparatus is powered on. Furthermore, the normal color misregistration correction procedure with time after the end of the initial color misregistration correcting operation (steps 406 to S409) is similar to that at steps S307 to S310 in the second embodiment, and is therefore not explained herein.

In this manner, in the image forming apparatus according to the third embodiment, a color misregistration correction is performed with the increased fixing temperature when a color misregistration correction is performed at the time of power-on the previous time. If the fixing temperature is not so low immediately after power-on this time, a color misregistration correction process is not required. Therefore, an initial color misregistration correction is not performed. On the other hand, if the fixing temperature is cool enough to equal to or smaller than the predetermined value immediately after power-on, the state is significantly different from the state with the last color misregistration correction performed the previous time, and therefore a color misregistration correction is performed. With this configuration, the necessity of a color misregistration correction immediately after power-on is appropriately determined, and a color misregistration correction immediately after power-on is performed only when necessary. With this, the initialization time of the apparatus can be reduced, and the load due to the operation of the image forming system can be reduced. As a result, the life of the image forming apparatus itself can be extended.

An image forming apparatus according to a fourth embodiment is different from that according to the second embodiment in that, when the image forming apparatus is powered on and when the temperature of the fixing unit 32 in the apparatus is cooler than a predetermined value, a color misregistration correction is not immediately performed, but is suspended until the temperature increases to be equal to or higher than a predetermined value, and when the temperature becomes equal to or higher than the predetermined value, a color misregistration correction operation is performed.

In the image forming apparatus according to the fourth embodiment, a color misregistration correction is performed after the state becomes such that a color misregistration may occur due to an increase in temperature of the fixing unit 32. That is, if a color misregistration correction is performed when the fixing temperature is equal to or lower than the predetermined value at the time of power-on, that is, the fixing unit 32 is cool, a color misregistration correction has to be performed again after the fixing temperature reaches a use-temperature and the entire apparatus is warmed up. To get around this problem, when the temperature of the fixing unit 32 is low, a correction is performed after the temperature is warmed up to the predetermined value. With this, a longer time can be taken until the next color misregistration correction, thereby reducing the frequency of the color misregistration correcting operation.

Figure 15:
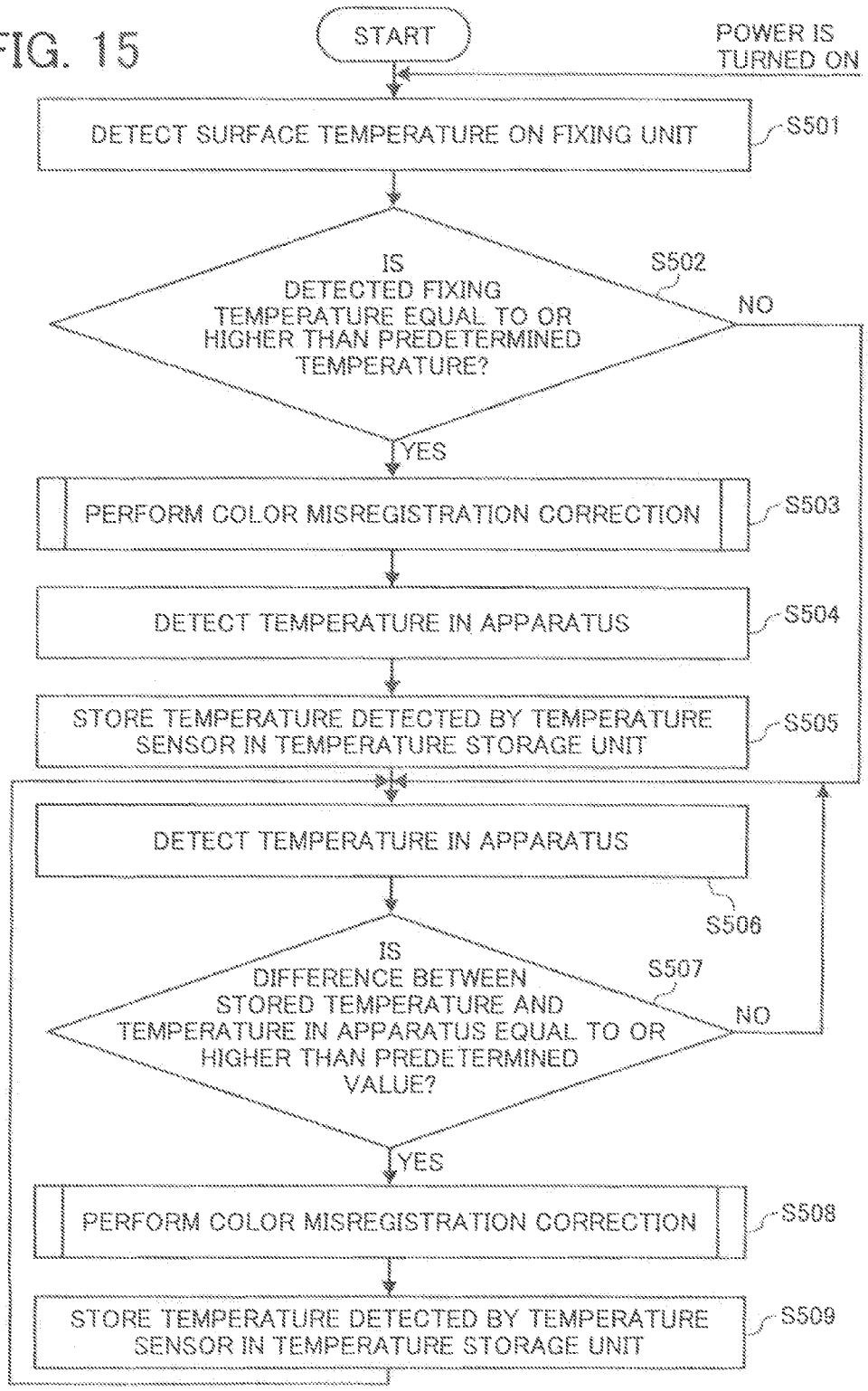
FIG. 15 is a flowchart for explaining a color misregistration correction according to a fourth embodiment of the present invention.

FIG. 15 is a flowchart for explaining a color misregistration correction according to a fourth embodiment of the present invention. When power is turned on, the fixing-temperature sensor 43 detects the surface temperature at the fixing unit 32 (step S501). The misregistration-amount calculating unit 212 determines whether the detected fixing temperature is equal to or higher than a predetermined temperature (step S502) and, when determining that the fixing temperature is not equal to or higher than the predetermined temperature (No at step S502), the procedure waits as it is.

On the other hand, when the misregistration-amount calculating unit 212 determines that the detected fixing temperature is equal to or higher than the predetermined temperature (Yes at step S502), the controlling unit 20 performs a color misregistration correction (step S503). Then, the temperature sensor 42 detects the temperature in the apparatus (step S504), and the misregistration-amount correcting unit 13 stores the temperature in the apparatus detected by the temperature sensor 42 in the temperature storage unit 14 (step S505). Of this procedure, steps S503 to S505 are similar to steps S303 to S305 according to the second embodiment, and are therefore not explained in detail.

The steps explained above form the initial color misregistration correcting operation immediately after the image forming apparatus is powered on. Furthermore, the normal color misregistration correction procedure with time after the end of the initial color misregistration correcting operation (steps 506 to S509) is similar to that at steps S307 to S310 in the second embodiment, and is therefore not explained herein.

In this manner, in the image forming apparatus according to the fourth embodiment, if the temperature of the fixing unit 32 in the apparatus is cooler than a predetermined value at the time of power-on, a color misregistration correction is not immediately performed, but is suspended until the temperature increases to be equal to or higher than the predetermined value. After the temperature of the fixing unit 32 becomes equal to or higher than the predetermined value, a color misregistration correcting operation is performed. If a color misregistration correction is performed when the temperature of the fixing unit 32 is not much increased, a color misregistration correction has to be performed again after increase. Therefore, when the fixing unit is cool at first, a correcting operation is suspended, and is then performed after increase, thereby reducing the frequency of a color misregistration correcting operation. With this, the initialization time of the apparatus can be reduced, and the load due to the operation of the image forming system can be reduced, thereby allowing the life of the image forming apparatus itself to be extended.

Figure 16:
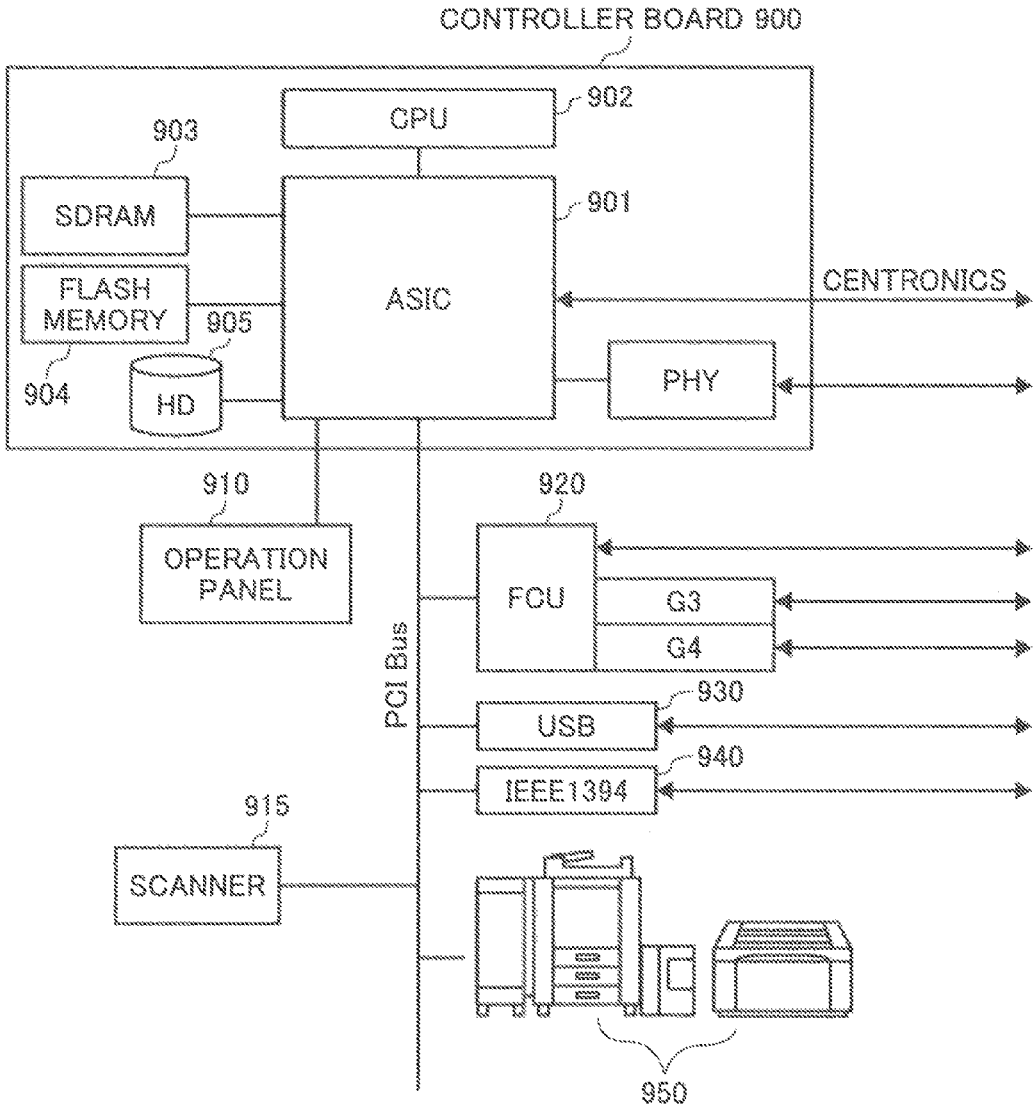
FIG. 16 is a view for explaining a hardware configuration of the image forming apparatus according to the embodiments.

FIG. 16 is a view for explaining a hardware configuration of the image forming apparatus according to the embodiments. As depicted in the drawing, this image forming apparatus includes a controller board 900 in which a central processing unit (CPU) 902, a synchronous dynamic random access memory (SRAM) 903, a flash memory 904, a hard disk (HD) 905, and others are connected to an application-specific integrated circuit (ASIC) 901; an operation panel 910; a facsimile controlling unit (FCU) 920; a Universal Serial Bus (USB) 930; an IEEE 1394 bus 940; a printer 950; and a scanner 915.

The operation panel 910 is directly connected to the ASIC 901. The FCU 920, the USB 930, the IEEE 1394 bus 940, the printer 950, and the scanner 915 are connected to the ASIC 901 via a PCI bus.

The HD 905 causes the CPU of the image forming apparatus to perform each procedure, or process, explained above, or has stored therein an image forming program for causing the function of each unit explained above to be performed.

Here, the color misregistration correction program and image forming program to be executed on the image forming apparatus may be provided as being recorded on a computer-readable recording medium, such as a CD-ROM, a flexible disk (FD), a CD-R, and a Digital Versatile Disk (DVD), with a file in an installable or executable format. In this case, the CPU 902 reads the color misregistration correction program and image forming program from the recording medium for loading on a main storage device, thereby causing the color image forming apparatus to perform each process explained above or to achieve the function of each unit.

The color misregistration correction program and image forming program to be performed on the image forming apparatus according to the embodiments has a module configuration including the units explained above (the pattern forming unit, the misregistration-amount calculating unit, the misregistration-amount correcting unit, the temperature storage unit, and the fixing-temperature storage unit). In actual hardware, the CPU (processor) 902 reads each program from the ROM for execution, thereby causing each unit to be loaded and generated on the main storage device.

Also, the color misregistration correction program and image forming program may be provided by storing these programs in a computer connected to a network, such as the Internet, and causing them to be downloaded via the network. Alternatively, the color misregistration correction program and image forming program may be provided or distributed via a network, such as the Internet.

In the embodiments, an image forming apparatus that uses toner for image-forming is explained. Although, the present invention is not restricted to the image forming apparatus that only uses toner for image-forming, but also can be applicable those using inkjet scheme and the like for image-forming.

According to the embodiment of the present invention, when a difference between the temperature of the image forming apparatus stored in the temperature storage unit and the temperature in the image forming apparatus detected by the temperature detecting unit is equal to or larger than a predetermined value, a pattern for measurement includes a plurality of colors is formed, and a misregistration for each color is calculated. With the calculated misregistration amount for each color, an image forming position, which is a position where a toner image for each color is to be formed, is corrected. According to corrected the image forming position, the toner image for each color is formed. Then, the toner image is superposed on a recording medium for transfer. With this, an effect can be achieved in which a color misregistration correcting operation is determined to be not required because the temperature difference is not satisfied, thereby eliminating an unnecessary color misregistration correction and allowing a color misregistration correction to be performed only when necessary.

According to the embodiment of the present invention, when the image forming position for each color is corrected, the temperature storage unit stores the temperature detected by the temperature detecting unit. When the difference between the temperature stored in the temperature storage unit and the temperature detected by the temperature detecting unit is equal to or larger than the predetermined value, the pattern for measurement includes the colors is formed, and the misregistration amount for each color is calculated. With this, an effect can be achieved in which a color misregistration correcting operation is determined to be not required because the temperature difference between the stored temperature and the detected temperature does not satisfy a predetermined value, thereby eliminating an unnecessary color misregistration correction and allowing a color misregistration correction to be performed only when necessary.

According to the embodiment of the present invention, when the image forming apparatus is powered on and when the difference between the temperature stored in the temperature storage unit and the temperature detected by the temperature detecting unit is equal to or larger than the predetermined value, the pattern for measurement includes the colors is formed, and the misregistration amount for each color is calculated. With this, an effect can be achieved in which a color misregistration correcting operation is performed only when, at the same time when the apparatus is powered on, the difference between the stored temperature and the detected temperature is equal to or larger than the predetermined value and is not performed when unnecessary, thereby eliminating waste and allowing a color misregistration correction to be performed only when necessary.

According to the embodiment of the present invention, when the difference between the temperature stored in the temperature storage unit and the temperature detected by the temperature detecting unit is smaller than a predetermined value, the misregistration-amount calculating unit is prevented from forming the pattern for measurement includes the colors and calculating the misregistration amount for each color. With this, a color misregistration correcting operation is not performed when unnecessary, thereby eliminating waste and allowing a color misregistration correction to be performed only when necessary.

According to the embodiment of the present invention, at least either one of a temperature of the fθ lens included in the exposing unit and an atmospheric temperature near the fθ lens is detected. With this, an effect can be achieved in which, with the temperature that particularly tends to cause a color misregistration being detected, necessity of performing a color misregistration correction can be correctly determined to perform a color misregistration correction only when necessary, thereby eliminating a wasteful color misregistration correcting operation when unnecessary.

According to the embodiment of the present invention, when a difference between the temperature stored in the fixing-temperature storage unit and the temperature detected by the fixing-temperature detecting unit is equal to or larger than a predetermined value, the pattern for measurement includes the colors is formed and the misregistration amount for each color is calculated. With this, an effect can be achieved in which necessity of performing a color misregistration correction is determined based on the fixing temperature difference to perform a color misregistration correction only when necessary, thereby eliminating a wasteful color misregistration correcting operation when unnecessary.

According to the embodiment of the present invention, when the difference between the temperature stored in the fixing-temperature storage unit and the temperature detected by the fixing-temperature detecting unit is equal to or smaller than a predetermined value, the pattern for measurement includes the colors is formed and the misregistration amount for each color is calculated. With this, an effect can be achieved in which, since a color misregistration correction value at the fixing temperature stored at the time of image formation can be used as it is if the fixing temperature is increased, necessity of performing a color misregistration correction is determined based on the fixing temperature difference to perform a color misregistration correction only when necessary, thereby eliminating a wasteful color misregistration correcting operation when unnecessary.

According to the embodiment of the present invention, when the temperature detected by the fixing-temperature detecting unit is equal to or lower than a predetermined temperature and after the temperature reaches the predetermined temperature, the pattern for measurement includes the colors is formed and the misregistration amount for each color is calculated. With this, an effect can be achieved in which, since a color misregistration correction is performed after the temperature of the fixing unit reaches a temperature at which a color misregistration occurs, necessity of performing a color misregistration correction is determined based on temperature changes of the fixing unit with time to perform a color misregistration correction only when necessary, thereby eliminating a wasteful color misregistration correcting operation when unnecessary.

According to the embodiment of the present invention, when a difference between the temperature stored in the fixing-temperature storage unit and the temperature detected by the fixing-temperature detecting unit is equal to or larger than a predetermined value or when the difference between the temperature of the image forming apparatus stored in the temperature storage unit and the temperature in the image forming apparatus detected by the temperature detecting unit is equal to or larger than a predetermined value, a pattern for measurement includes a plurality of colors is formed, and a misregistration amount for each color is calculated. With this, an effect can be achieved in which a color misregistration correcting operation is determined to be not required because the temperature difference is not satisfied, thereby eliminating an unnecessary color misregistration correction and allowing a color misregistration correction to be performed only when necessary.

According to the embodiment of the present invention, a pattern for measurement includes a plurality of colors is formed and a misregistration for each color is calculated when a difference between a temperature of the image forming apparatus stored in a temperature storage unit and a temperature in the image forming apparatus detected by a temperature detecting unit is equal to or larger than a predetermined value. With the calculated misregistration amount for each color, an image forming position, which is a position where a toner image for each color is to be formed, is corrected. According to the corrected image forming position, the toner image for each color is formed and superposed on a recording medium for transfer. With this, an effect can be achieved in which a color misregistration correcting operation is determined to be not required because the temperature difference is not satisfied, thereby eliminating an unnecessary color misregistration correction and allowing a color misregistration correction to be performed only when necessary.

According to the embodiment of the present invention, when the image forming position for each color is corrected and when a difference between the temperature stored in the temperature storage unit that stores the temperature detected by the temperature detecting unit and the temperature detected by the temperature detecting unit is equal to or larger than the predetermined value, a pattern for measurement includes a plurality of colors is formed and a misregistration amount for each color is calculated. With this, an effect can be achieved in which a color misregistration correcting operation is determined to be not required because the temperature difference between the stored temperature and the detected temperature does not satisfy a predetermined value, thereby eliminating an unnecessary color misregistration correction and allowing a color misregistration correction to be performed only when necessary.

According to the embodiment of the present invention, at least either one of a temperature of an fθ lens and an atmospheric temperature near the fθ lens is detected by the temperature detecting unit. With this, an effect can be achieved in which, since the temperature that particularly tends to cause a color misregistration being detected, necessity of performing a color misregistration correction can be correctly determined to perform a color misregistration correction only when necessary, thereby eliminating a wasteful color misregistration correcting operation when unnecessary.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a temperature storage unit that stores therein a reference temperature value;

a temperature detecting unit that detects a temperature within the image forming apparatus immediately after power is turned on;

a determining unit that determines whether a difference between the reference temperature value and the temperature detected by the temperature detecting unit is equal to or larger than a first value, the temperature storage unit updating and storing the temperature detected by the temperature detecting unit as a new reference temperature value when the difference between the reference temperature value and the temperature detected by the temperature detecting unit is equal to or larger than the first value;

a pattern forming unit that, when the determining unit determines that the difference is equal to or larger than the first value, forms a pattern for measurement including sub-patterns of a plurality of parallel color strips on a transfer medium;

a position detecting unit that detects positions of the sub-patterns of each of the colors on the transfer medium;

a calculating unit that calculates a misregistration-amount for each sub-pattern based on the position of the sub-pattern and a predetermined position for that sub-pattern;

a correcting unit that corrects a position on which a sub-pattern is to be formed based on the misregistration-amount for that sub-pattern; and an image forming unit that forms an image for each color on the transfer medium using the position of a color corrected by the correcting unit, and superposes the image onto a recording medium, wherein the pattern forming unit is prevented from forming the pattern when the determining unit determines that the difference is smaller than a second value.

2. The image forming apparatus according to claim 1, wherein the pattern forming unit forms the pattern when the image forming apparatus is powered on and when the determining unit determines that the difference is equal to or larger than the first value.

3. The image forming apparatus according to claim 1, further comprising an exposing unit that includes an fθ lens and applies an optical beam according to image information to form an electrostatic latent image on an image carrier by using the fθ lens, wherein the temperature detecting unit detects at least either one of a temperature of the fθ lens and an atmospheric temperature near the fθ lens.

4. The image forming apparatus according to claim 1, further comprising:

a fixing unit that fixes the image on the recording medium;

a fixing-temperature storage unit that stores a temperature of the fixing unit; and a fixing-temperature detecting unit that detects a temperature of the fixing unit, wherein the pattern forming unit forms the pattern when a difference between the temperature stored in the fixing-temperature storage unit and the temperature detected by the fixing-temperature detecting unit is equal to or larger than a third value.

5. The image forming apparatus according to claim 4, wherein the pattern forming unit forms the pattern when the temperature detected by the fixing-temperature detecting unit is equal to or smaller than a fourth value.

6. The image forming apparatus according to claim 4, wherein the pattern forming unit forms the pattern when the temperature detected by the fixing-temperature detecting unit is equal to or lower than a fifth value and after the temperature reaches the fifth value.

7. The image forming apparatus according to claim 4, wherein the pattern forming unit forms the pattern when a difference between the temperature stored in the fixing-temperature storage unit and the temperature detected by the fixing-temperature detecting unit is equal to or larger than the third value or when the difference between the temperature of the image forming apparatus stored in the temperature storage unit and the temperature in the image forming apparatus detected by the temperature detecting unit is equal to or larger than the first value.

8. The image forming apparatus according to claim 1, wherein, when the image forming apparatus is powered on and a difference between a temperature corresponding to a last misregistration correction and a currently detected temperature is equal to or larger than a predetermined value, a color misregistration correction is performed, the color misregistration correction not being performed when the difference is smaller than the predetermined value.

9. A method of correcting color misregistration in an image forming apparatus, the method comprising:

detecting an internal temperature of the image forming apparatus immediately after power is turned on;

determining whether a difference between a reference temperature value and the internal temperature is equal to or larger than a first value;

forming a pattern for measurement including sub-patterns of a plurality of parallel color strips on a transfer medium when it is determined at the determining that the difference is equal to or larger than the first value;

detecting positions of the sub-patterns of each of the colors on the transfer medium;

calculating a misregistration-amount for each sub-pattern based on a detected position of the sub-pattern and a predetermined position for that sub-pattern;

correcting a position on which a sub-pattern is to be formed based on the misregistration-amount;

storing the internal temperature as a new reference temperature value that replaces the reference temperature value after the correcting;

forming an image for each color on the transfer medium using a corrected position for each color so as to superpose the formed image onto a recording medium; and preventing the pattern from forming when it is determined at the determining that the difference is smaller than a second value.

10. The method according to claim 9, wherein the forming a pattern includes forming the pattern when the image forming apparatus is powered on and when it is determined at the determining that the difference is equal to or larger than the first value.

11. The method according claim 9, wherein the detecting a temperature includes detecting at least one of a temperature of an fθ lens and an atmospheric temperature near the fθ lens, both the fθ lens and a location of the atmospheric temperature detection being present in the image forming apparatus.

12. The method according to claim 9, further comprising:

detecting a fixing-unit temperature that is a temperature of a fixing unit that fixes toner image onto the recording medium; and determining whether a difference between the reference temperature value and the fixing-unit temperature is equal to or larger than a third value, wherein the forming a pattern includes forming the pattern when it is determined at the determining that the difference is equal to or larger than the third value.

13. The method according to claim 12, further comprising determining whether the fixing-unit temperature is equal to or smaller than a fourth value, wherein the forming a pattern includes forming the pattern when it is determined at the determining that the fixing-unit temperature is equal to or smaller than the fourth value.

14. The method according to claim 12, further comprising determining whether the fixing-unit temperature is equal to or lower than a fifth value, wherein the forming a pattern includes forming the pattern after the fixing-unit temperature reaches the fifth value when it is determined at the determining that the fixing-unit temperature is equal to or lower than the fifth value.

15. The method according to claim 12, wherein the forming a pattern includes forming the pattern when it is determined that the difference between the reference temperature value and the fixing-unit temperature is equal to or larger than the third value, or is determined that the difference between the reference temperature value and the internal temperature is equal to or larger than the first value.

16. The method according to claim 9, further comprising:

determining a difference between a temperature corresponding to a last misregistration correction and a currently detected temperature;

determining whether the difference is equal to or larger than a predetermined value; and performing a color misregistration correction when the difference is larger than the predetermined value, the color misregistration correction not being performed when the difference is smaller than the predetermined value.

* * * * *